United States Patent [19]

Cirami

[11] Patent Number: 4,957,261

[45] Date of Patent: Sep. 18, 1990

[54] COPYHOLDER/ORGANIZER

[76] Inventor: Salvatore Cirami, 12-21 35th Ave., Apt. 4F, Long Island City, N.Y. 11106

[21] Appl. No.: 367,438

[22] Filed: Jun. 16, 1989

Related U.S. Application Data

[63] Continuation-in-part of Ser. No. 68,460, Jul. 1, 1987, abandoned.

[51] Int. Cl.[5] ..... A47G 1/24

[52] U.S. Cl. ..... 248/454; 248/451; 248/918

[58] Field of Search ..... 248/454, 450, 444, 447, 248/457, 464, 282, 442.2, 463, 453, 451, 459, 146, 152, 127; 400/718

[56] References Cited

U.S. PATENT DOCUMENTS

| | | | |
|---|---|---|---|
| 289,652 | 12/1883 | Haynes | 248/451 |
| 551,256 | 12/1895 | Brown | 248/451 |
| 630,231 | 8/1899 | Hudgin | 248/460 |
| 981,177 | 1/1911 | Deem | 248/460 X |
| 1,242,914 | 10/1917 | Blatt | 248/453 |
| 1,540,242 | 6/1925 | Bell | 248/457 |
| 1,812,318 | 6/1931 | Bower | 248/453 X |
| 2,168,551 | 8/1939 | Alexander | 248/460 |
| 2,574,575 | 11/1951 | MacIntyre | 248/442.2 X |
| 2,807,908 | 10/1957 | Lylas | 248/451 |
| 2,889,036 | 6/1959 | Davies | 248/460 |
| 2,957,669 | 10/1960 | Berlin | 248/121 |
| 3,079,725 | 3/1963 | Fleur | 248/441.1 |
| 3,809,352 | 5/1974 | Mathias | 248/444.1 |

FOREIGN PATENT DOCUMENTS

| | | | |
|---|---|---|---|
| 463785 | 8/1928 | Fed. Rep. of Germany | 248/441.1 |
| 511600 | 12/1920 | France | 248/451 |
| 1060589 | 4/1954 | France | 248/457 |

*Primary Examiner*—J. Franklin Foss

[57] ABSTRACT

A forwardly inclined storage unit is secured behind a rearwardly inclined copyboard so that the two converge. The storage unit provides at least one compartment—for placement of draft pages as they are removed from the copyboard, and preferably, a second compartment for newly typed or computer printed pages. Because of the forward inclination of the storage unit, pages or printed portions of a document dropped sequentially into the compartments lean face down, thereby retaining collation. Preferred embodiments include an elongated planar base the rearward end only of which is secured to the storage unit whereby the copyboard is supported by the storage unit at an elevation spaced well above the forward end of the base in order to provide clearance under the copyboard for placement of rider pages resting on the base; the base is much narrower at its forward end than at its rearward end whereby when the base is positioned with one of its sides in abutment against one end of a desktop computer's keyboard the copyboard partially overlies same and is thereby located comfortably close to the computer's display screen; and the copyboard and base are foldable against the storage unit for compact storage or portability. Alternative one-piece and two-part constructions of the storage unit are disclosed.

14 Claims, 5 Drawing Sheets

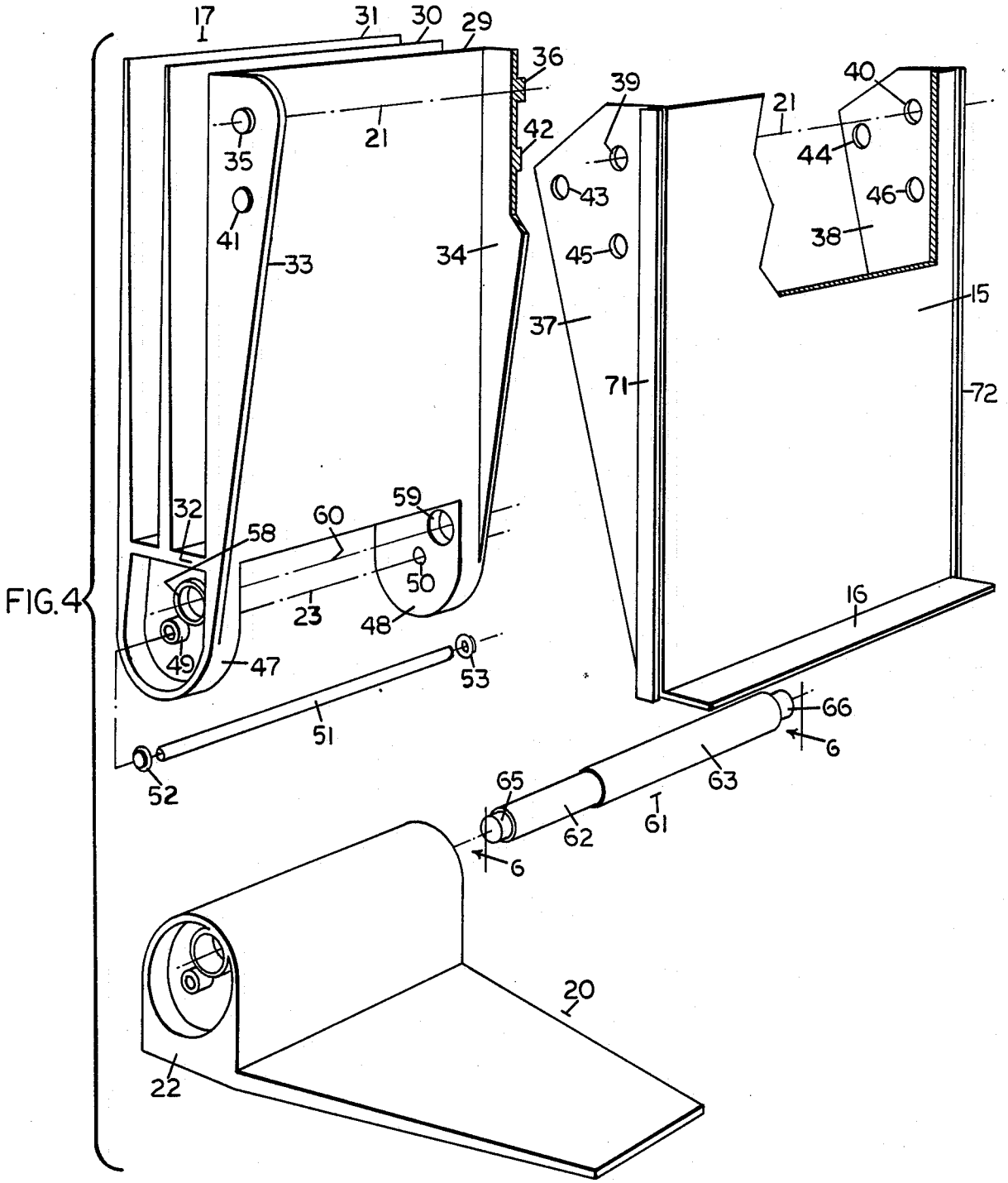
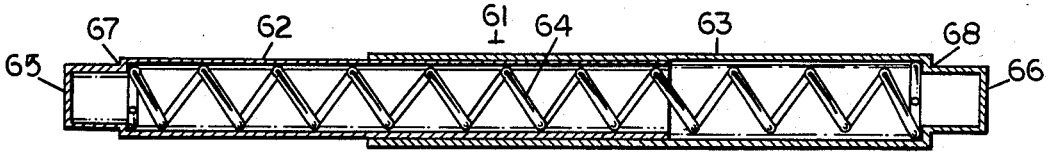
FIG. 6

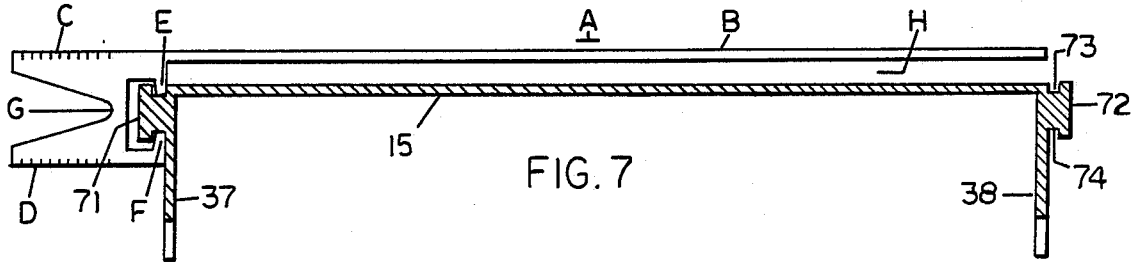
FIG. 7
FIG. 8
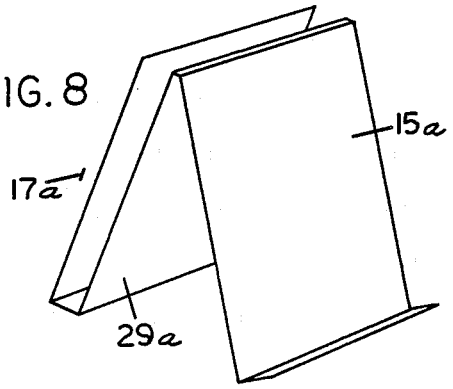
FIG. 9
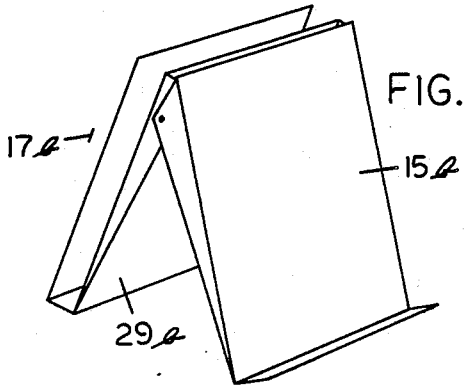
FIG. 10
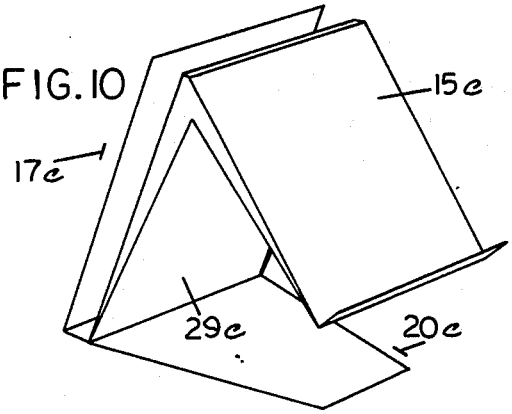
FIG. 11
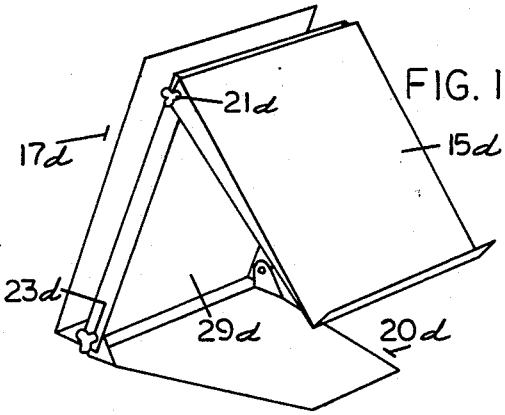
FIG. 12
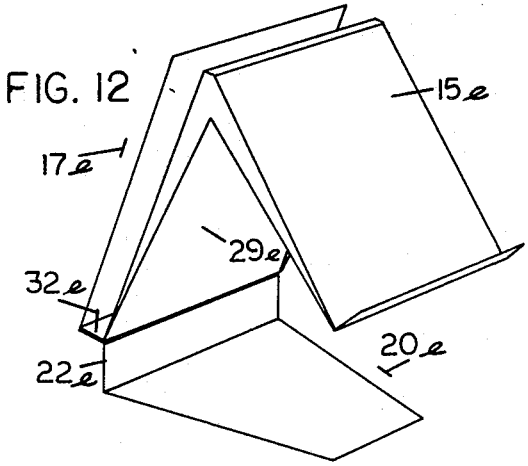

FIG. 13
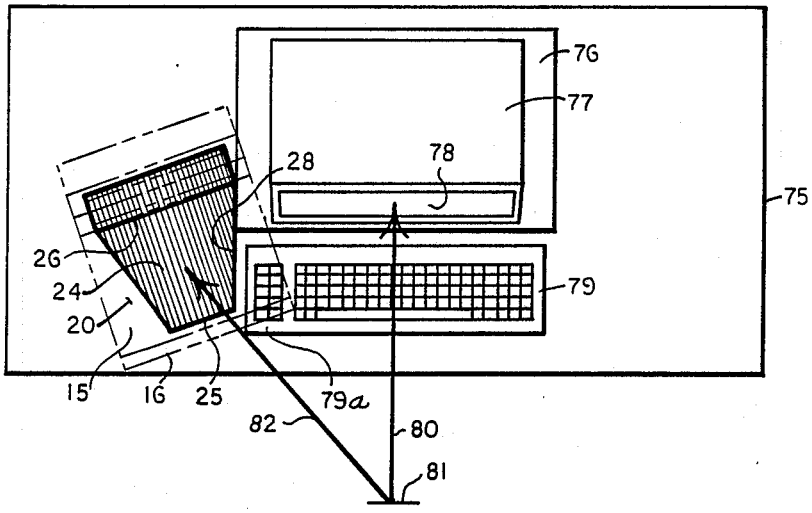
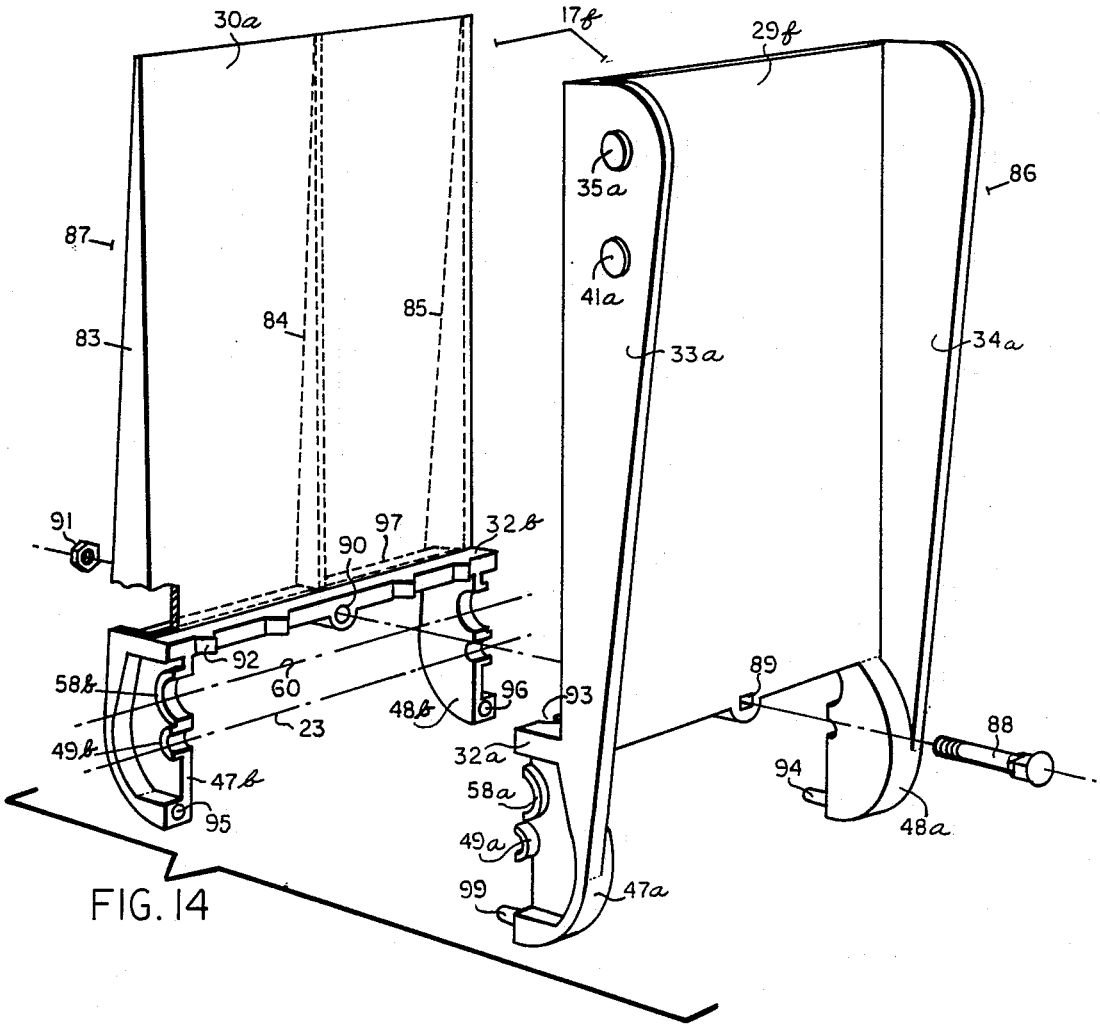
FIG. 14

COPYHOLDER/ORGANIZER

BACKGROUND OF THE INVENTION

This disclosure is a continuation-in-part of and was filed copending with an original application, Ser. No. 07/068,460, filed Jul. 1, 1987, and now abandoned. Benefit of the filing data of the original application is claimed with respect to common subject matter.

1. Field of the Invention

This invention pertains to an improvement in the art of copyholders of the type used by a typist to support a document next to a typewriter or desktop computer at which the typist is seated. Typist's copyholders are manufactured and sold in different sizes proportioned for used with a given standard size of stationery intended for use in a typewriter or the printer component of a desktop computer; referred to herein as "typewriter paper" whether used in a typewriter or a computer's printer and meaning having a given width measuring 8 or 8½ inches and a given length measuring 11, 13 or 14 inches 8½ by 11 inches being the most common size. Accordingly, one characteristic defining the field of the invention pertains to the environment of use which dictates an overall size appropriate for use on a desktop for placement alongside a typewriter or desktop computer and related to a given standard size of typewriter paper, especially size 8½ by 11 inches.

Another characteristic defining the field of the invention pertains to the presence of structure that is common to all copyholders of the type referred to. Such essential structure is a rearwardly inclined board, having length and width related to a given standard size of typewriter paper, especially size 8½ by 11 inches, inclusive of a flat shelf at its lower end projecting sharply forwardly at right angles to the board as appropriate for support without slippage therefrom of a document which may comprise a substantial number of pages which will be provided or made loose (as opposed to being bound) in order that pages can be set aside sequentially as reading from them is completed. Since such structure is frequently used for support of a plurality of loose pages, it must have a rearward inclination that makes it a practical resting surface for loose pages: not too shallow or else the text will be uncomfortable to read and the purpose of the copyholder negated, and not too close to vertical or else pages will tend to curl off the board.

The structure described in the preceding paragraph is common to all copyholders within the field of the invention and is herein termed a "copyboard"; a term used herein which shall be understood to have the special meaning. defined in the preceding paragraph. The term "copyboard" is relied on herein to specifically define the field of the invention and appertaining art and to exclude structures not suitable to serve the purpose of a typist's copyholder.

2. Description of the Prior Art

The process of creating or revising a multipage document includes setting aside earlier completed draft and printed pages in their original order of assembly until the rest of the work is finished. It may also include referring to rider pages which have been set aside until needed for inserting additional text where indicated on the main document. Prior art copyholders do not provide storage for set aside pages or ensure a placement for rider pages and to that extent do not fully reflect the work process. Conventionally, the typist is surrounded by a clutter of papers the management of which reduces efficiency. The speed at which the work is now performed using a computer has accentuated the need for a copyholder that organizes papers for reduced handling.

Conventionally, set aside draft pages and printouts are placed:

(a) on the typing table, where they eliminate needed free space;

(b) on an adjacent desk serving as a workspace, where they reduce or eliminate free space, may lie on top of and thereby block access to materials on the desk (pen, pencil, paper clips, telephone message pad, etc.) or may become interleaved with other papers;

(c) on a chair drawn up alongside the typist;

(d) on the typist's lap; or, (e) on top of the computer's monitor.

Obviously, all of these placements are undesirable because they (i) result in a confusion of papers that is tiresome to keep sorted and to that extent slow the work process, (ii) in a commercial environment, create an impression of disorganization that should be avoided in a business office, and (iii) may result in misplaced papers.

Conventionally, collation is dependent upon a special attention on the part of the typist when the draft pages and printouts are set aside in the various places listed above and that easily leads to error. Specifically, pages must consistently be set aside with the text side face down so that later completed pages will be located on top of and thereby sequenced behind earlier ones. But it often happens that a page that has been so set aside must be compared with work currently in progress and this requires turning such page face up for a time. Unless the typist unfailingly remembers to return such reversed page to its face down position before placing the next completed page on top it—thereby concealing the reversed position of the underlying page—the document of which such page is a part may be returned to its author containing reversed pages.

There is need for a copyholder that provides storage for set aside pages in a manner that ensures retention of collation.

Rider pages may be provided either grouped together or interleaved with the pages of the main body of the document. In either case, the work process frequently requires setting such rider pages aside for a time at a placement where they can be identified as needed. Prior copyholders do not ensure a convenient placement and this adds further to the previously described clutter of set aside draft pages and printouts.

In a copyholder having its copyboard supported at an elevation above a base, a convenient placement for rider pages would be under the copyboard resting on the base. But conventional such copyholders are impractical to use in this manner because the base is obstructed by a post or other structure that extends between the base and the underside of the copyboard for support of the copyboard, and the portion of the base surrounding such structure being typically so bulky with respect to its vertical dimension that if a rider page is rested on it the page easily slides off onto the floor.

There is need for a copyholder having its copyboard supported at an elevation above a base in a manner that presents no obstruction under the copyboard that would preclude placement of rider pages there, and that provides such feature in combination with a base that is sufficiently planar for resting a rider page.

A copyholder used with a desktop personal computer should have its copyboard elevated, and ideally, also laterally adjustable, because such features minimize eye travel in glancing between the copy and the computer's display screen, making the work less tiring and thereby increasing efficiency.

In some environments copyholders need not be moved about and it and may be desirable to utilize copyholders that are bulky, heavy or otherwise inconvenient to carry so as to discourage unauthorized transference from one work station to another or unauthorized removal from the premises. In other environments it is preferred that the copyholder be readily foldable either for storage in a desk drawer for aesthetic reasons when not actually in use, or for positive security by storing in a desk drawer that is equipped with a lock, or, for portable use.

The prior art does not provide both elevation and lateral adjustability of the copyboard in a foldable copyholder. As a result, neither permanent-employee computer operator/secretaries desiring to store their copyholder, on the one hand, nor computer operators working as self-employed free lancers or office temporaries and desiring to carry a personally owned copyholder to their work assignments, on the other hand, have available to them a copyholder that meets their needs.

In the current market environment, foldability is known to be provided only in what might be termed a "direct-standing" type of copyholder wherein the copyboard stands directly on the desktop and has a supporting leg structure that is pivotally secured to and foldable against the rearward side of the copyboard. This type of copyholder can readily be stored or carried, the simplicity of its construction makes it both inexpensive and durable and its copyboard is firmly supported; but it is uncomfortable to use with a computer because its copyboard is neither elevated nor laterally adjustable.

Conventionally, elevation and lateral adjustability are provided in combination only by inclusion of structure one end of which is secured to the underside of the copyboard and the opposite end of which is pivotally secured to either a weighted base or a desktop attachable clamp and is adapted to enable movement of the copyboard laterally relative to the weighted base or clamp. One construction uses a parallelogram mechanism; another, an arm that can be swung laterally. All copyholders having such additional structure are inherently too bulky for compact foldability and their weight and cost is incompatible with the present goal of providing foldability in a lightweight, inexpensive construction suitable for portable use. Moreover, the inclusion of such additional structure for effecting lateral adjustability of the copyboard results in the copyboard not being supported in a firm manner because dependent upon jointed elements which eventually loosen. Further, in order to have the strength that such constructions require, they must made of metal, typically steel, which leads to further disadvantages of increased weight and cost compared to copyholders made substantially entirely of plastic.

Although the prior art includes lightweight, inexpensive plastic copyholders having an elevated copyboard and some provide the copyboard rotatable about a vertical axis on a post that extends between the underside of the copyboard and a base, no lightweight, all-plastic copyholder is known that provides the copyboard elevated and at the same time provides the copyboard movable laterally with respect to the base; none is foldable and elevation of the copyboard is attained in a way that obstructs placement of rider pages under the copyboard—elevation being attained by means of the referred-to post that extends directly between the underside of the copyboard and a base. Obviously, in a lightweight copyholder the base is not weighted, so it is impractical to have the copyboard movable laterally relative to its base because that would shift the center of gravity of the copyholder and thereby unbalance it. Conventionally, the base has a substantially rectangular or circular shape the dimensions of which are such that when the base is positioned in abutment against one end of the central processing unit or the keyboard of a desktop personal computer, the copyboard remains spaced undesirably far away from the computer's display screen and cannot be pushed or positioned as closed as desired.

There is need for a lightweight, inexpensive plastic copyholder that proviedes both elevation and lateral adjustability of the copyboard, leaves the base free for placement of rider pages, and in addition, is compactly foldable.

The following art was cited during examination of the original application for patent:

| Issue Year | Country | Patent Number | Inventor | Title |
|---|---|---|---|---|
| 1876 | U.S. | 183,800 | Durant | School-Desks |
| 1883 | U.S. | 289,652 | Haynes | Book Rest |
| 1895 | U.S. | 551,256 | Brown | Book Rest |
| 1899 | U.S. | 630,231 | Hudgin | Copy Holder |
| 1904 | U.S. | 774,661 | French, et al. | Pad-Holder |
| 1911 | U.S. | 981,177 | Deem | Display Device |
| 1912 | U.K. | 14,238 | Moser | Improved Support or Base Piece, for Tablets, Cards, Pictorial or Other Labels or Tickets Particularly Suitable For Advertising Purposes |
| 1917 | U.S. | 1,242,914 | Blatt | Stenographer's Note-Book Stand and Book-Mark |
| 1920 | Fr. | 511,600 | Hallard | Porte-copie pour machine a encrire |
| 1925 | U.S. | 1,540,242 | Bell | Holder For Counter Check Books And The Like |
| 1928 | Ger. | 463,785 | Kuhn | [Interpreted as Calendar Holder] |
| 1930 | Ger. | 507,700 | Haberfeld | Teaching Aid For Loose-Leaf Bookkeeping |
| 1931 | U.S. | 1,812,318 | Bower | Display Device |
| 1939 | U.S. | 2,168,551 | Alexander | Holder For Cross-Word Puzzles |
| 1943 | U.S. | 2,331,595 | Bush | Adjustable Support For Manuscripts, Books, Or The Like |
| 1951 | U.S. | 2,574,575 | MacIntyre | Paper Storage And Page End Indicating Attachment For Typewriters |
| 1954 | Fr. | 1,060,589 | Gazet | Designer's Table |
| 1957 | U.S. | 2,807,908 | Lykes | Copy Holding Device For Reading Stand |
| 1959 | U.S. | 2,889,036 | Davies | Loose Leaf Holder and |

-continued

| Issue Year | Country | Patent Number | Inventor | Title |
|---|---|---|---|---|
| | | | | Display Device |
| 1963 | U.S. | 3,079,725 | La Fleur | Catalog Holder Structure |
| 1970 | U.S. | 3,490,600 | Reed, et al. | Display Device |
| 1974 | U.S. | 3,809,352 | Mathias | Book Holder And Shield |
| 1976 | U.S. | 3,937,435 | Roberts | Page Holder And Book Support |
| 1983 | U.S. | 4,400,161 | Gerlt | Graphic Display And Tonal Value Determinator |

24 patents are listed above, spanning a period of 107 years.

None of the patents listed above pertains to provision of a storage unit in a typist's copyholder for setting aside pages removed from the copyboard.

Accordingly, none of the patents listed above is capable of teaching the narrower concept that is the broadest idea characterizing the present invention: provision of such a storage unit forwardly inclined with respect to the rearwardly inclined copyboard of a copyholder in order to attain collation of stored, set aside pages.

None of the patents listed above teaches the further idea characterizing the present inventive concept which pertains to provision of a planar base that supports a forwardly inclined storage unit by attachment of the rearward end only of such base to such storage unit, whereby the surface of such base is provided entirely free for placement of a rider page on same; the copyboard being supported at an elevation spaced well above the base and supported exclusively by attachment of the upper end of the copyboard to the upper end of such forwardly inclined storage unit. The closest art is the 1899 patent to Hudgin, U.S. Pat. No. 630,231, which provides a base that is pivotally secured at its rearward end to an upright frame (not a storage unit) but which includes rods extending diagonally from such frame to such base, and which provides an additional hinged frame structure interposed between the upper end of its copy support means and the main frame structure.

None of the patents listed above teaches the further idea characterizing the present inventive concept which pertains to provision of a copyholder having a planar base secured at its rearward end only, and in addition, being proportioned so much narrower at the front than at the rear that lateral adjustability of the copyboard is effected simply by rotating the copyholder as a whole on the desktop whereby the copyboard is enabled to overlie structure brought into abutment against one side of such base.

None of the patents listed above teaches the further idea characterizing the present inventive concept which pertains to the specific means provided for locking the pivotally secured copyboard and base in their unfolded position whereby particular economy of manufacture and simplicity of use are attained.

And, none of the patents listed above teaches the further idea characterizing the present inventive concept which pertains to provision of a split storage unit; i.e., molded in two parts which are thereafter rigidly secured together by fastener means, the two parts being joined at the floor member of the storage unit along an irregular parting line.

However, Mathias, U.S. Pat. No. 3,809,352, is of special interest because it discloses structure that at first glance is remarkably similar to the simplest embodiment of the present invention illustrated in FIG. 8 of the accompanying drawings and which is encompassed by applicant's broadest claim. But the Mathias patent does not pertain to a copyholder, does not teach the present inventive concept, either in its broadest terms or as further characterized, does not propose a possible use as a copyholder, and, the structure disclosed would require modification in order to give physical expression to the result attained by applicant's FIG. 8 embodiment. Accordingly, the Mathias patent discloses neither applicant's inventive concept nor the specific means of attainment. Nonetheless, the similarity in appearance is striking enough to justify the detailed consideration provided below.

The Mathias patent pertains to a book holder including a shield. The book holder appears at first glance to be the present FIG. 8 embodiment turned around 180 degrees for a different purpose and it is easy to conclude that the construction disclosed by Mathias makes the present FIG. 8 embodiment merely a new use of an old thing. It is necessary, therefore, to establish herein the distinctions therebetween. The Abstract of the Mathias patent is quoted below in its entirety:

> "A book holder formed preferably from a sheet of transparent synthetic resin of suitable thickness to render it relatively stiff and including a book-supporting panel disposed at an acute angle relative to a supporting surface such as a table or the like, a bracing panel extending angularly rearward and downward from the upper edge of the supporting panel, and a transparent holding and viewing panel spaced sufficiently from the book-supporting panel to accommodate a book in open condition and overlying the exposed pages of the book to render the same visible and prevent contact of the surfaces of the pages by any extraneous material. The book-supporting and transparent holding and viewing panel form a slot to recieve a book in open condition, the lower edges of the two panels being connected by a short section of the material comprising a ledge upon which the lower edge of the book rests, and the lower edge of the *supporting* panel also preferably being bent smoothly outward to form a flange capable of serving as an individual book supporting ledge in relation to the bracing panel."

Note: The next-to-last occurrence of the word "supporting" in the Abstract quoted above is apparently an error and should be read as "bracing". (See Mathias, Specification, Col. 3, Lines 5-18)

The "transparent holding and reviewing panel" is the forwardmost or first panel of Mathias's construction. Mathias's holding/viewing panel, which is rearwardly inclined, must necessarily be transparent in order to permit reading the book. Mathias's holding/viewing panel corresponds with applicant's "second panel" which is forwardly inclined and does not require transparency.

Mathias's "book-supporting panel", which is rearwardly inclined, corresponds with applicant's "second panel" which is forwardly inclined.

The holding/viewing and book-supporting panel are connected at their lower ends by a "ledge" which corresponds to applicant's "floor member".

Mathias's "bracing panel", which is forwardly inclined and includes "an additional book supporting ledge", corresponds to applicant's "copyboard" which is rearwardly inclined and includes a "shelf".

The lower end of Mathias's holding/viewing panel is spaced a suggested (in the disclosure) two inches apart from the lower end of the "book-supporting panel" in order that there may be held between the holding-/viewing and book-supporting panels a book having a thickness up to approximately two inches.

As so far described, and if the reader has overlooked certain key language of the Mathias disclosure quoted above, the structure provided by Mathias for holding a book appears to be equivalent to the storage unit of the present invention (as illustrated in FIG. 8 hereof) but used in a reverse manner for a different purpose—i.e., that applicant's FIG. 8 embodiment is merely a new use of an old thing. However, on closer examination, substantial differences emerge.

The upper end of Mathias's holding/viewing panel converges toward the upper end of the block-supporting panel to within a suggested (in the disclosure) half-inch of same:

> "... to provide, in conjunction with the natural resilience of the material, a somewhat elastic *clamping* arrangment operable *to hold the exposed pages of an open book in substantially flat condition*, as well as to accommodate the holder to hold books of different thicknesses and in view of such uneven spacing between the upper and lower portions of the panels which form said channel, relatively thin book may be held in open condition with the pages arranged substantially flat, as well as thicker books being accommodated and the pages thereof held in relatively flat condition when mounted within said channel."
> (Mathias, Specification, Col. 2, Lines 51–62) (emphasis added)

It is therefore apparent that Mathias's construction of the viewing and book-supporting panels provides a type of holder that functions to *clamp* the article held. This is functionally the reverse of this inventor's construction wherein the first and second panels are spaced apart at their upper ends at least as far, and preferably further apart, than they are at their lower ends, in order to provide and ensure *clearance* between the second panel and the article contained, namely, loose pages; such clearance being essential for attainment of the invention (being necessary in order to enable freely dropping pages into the storage compartment).

There is no further cooperative relationship between Mathias's bracing panel and his book-supporting panel beyond the disclosed one of supporting the book-supporting panel and holding/viewing panel with their interconnecting ledge at their rearwardly inclined angle. The ledge provided on the bracing panel does not convert same into a copyboard as defined herein, nor a copyboard that is in cooperative relationship with the remaining structure to achieve a single, unitary result; but instead serves only to enable an *alternative* mode of use of his device and does not contribute to its primary mode of use:

> "One further object of the invention is to terminate the lower end of the bracing panel in a smoothly curved, outwardly extending flange which is substantially perpendicular to the plane of the bracing panel and, in addition to forming a smoothly curved lower edge for the bracing panel so as to minimize the possibility of scratching and damaging a supporting surface such as a table top, also provide another book-supporting ledge which may be used in conjunction with the bracing panel to comprise *an additional book support under circumstances where it is not necessary or desirable to utilize the transparent holding and viewing panel of the book holder comprising other aspects of the present invention.*"
> (Mathias, Specification, Col. 3, Lines 5–18) (emphasis added)

Finally, among other distinctions (specified in the Summary of the Invention and pointed out in the Description of Preferred Embodiments sections of the present disclosure), this inventor's construction distinguishes from Mathias's construction by restriction of the copyboard and first panel to having a length at least equal to the length of a given standard size of typewriter paper, in order to preclude interference between any page resting on the copyboard and any page set aside in the storge compartment—a cooperative relationship not characterizing the relationship between Mathias's bracing panel and his book-supporting panel; and further, by restriction of this inventor's first panel to having a width less than the width of such standard size of typewriter paper—to enable tapping pages laterally out of the storage compartment; a distinction not necesary or desirable where the article held is a book having its pages clamped flat.

SUMMARY OF THE INVENTION

The main object of the invention is to provide a desktop-standing copyholder/organizer that provides collated storage for set aside draft pages; attained by a combination comprising:

1. a rearwardly inclined copyboard, comprising, and the term "copyboard" meaning:
   (a) that structure of a conventional typist's copyholder used for support of a document existing on a given standard size of typewriter paper having a given width and given length and frequently comprising a plurality of loose pages;
   (b) such copyboard comprising a board having upper and lower ends and including a shelf projecting forwardly from its lower end sharply enough that pages do not tend to slide off the shelf;
   (c) inclined at an angle suitable to keep such pages leaning on the copyboard and not curling off same while supporting such pages upright enough so that pages can comfortably be read by a typist seated at a typewriter or desktop computer;
   (d) the shelf being deep enough to support a given maximum number of pages; and,
   (e) the board having a length as measured from its extreme upper end to the shelf at least equal to the length of said given standard size of typewriter page;
2. a rigid, forwardly inclined storage unit; comprising:
   (a) a floor member and first and second panels, the panels being forwardly inclined, the floor member being flat and downwardly inclined from the second panel to the first panel, the panels having upper and lower ends and forward and rearward sides, the lower ends of the panel being fixed to the floor member spaced apart on same a given distance, the panels rising from the floor member such that the spaced apart relationship of the panels at their upper ends is equal to or greater than that existing at their lower ends; the space effectively enclosed between the panels and floor member defining a storage compartment; except for the floor member, no structure being provided (above the elevation of the floor member) connecting the first and second panels together, the storage compartment thereby being open at the top and at laterally opposed sides;

(b) the first panel:

(i) rising sharply and substantially squarely from the floor member;

(ii) having a length as measured from its extreme upper end to the floor member at least equal to the length of said given standard size of typewriter paper; and, (iii) having a width at least a portion of which is less than the width of said given standard sizes of typewriter paper;

(c) the second panel:

(i) having its lower end spaced apart from the lower end of the first panel a minimum given distance great enough to provide storage capacity for said given maximum number of pages plus clearance between the last of such maximum number of pages and the forward side of the second panel sufficient for freely dropping such last page into the storage compartment;

(ii) having a length as measured from its extreme upper end to the floor member equal to or greater than the length of the first panel;

(iii) having its upper end spaced apart from the upper end of the first panel a distance equal to or greater than the given distance recited in subparagraph 2(*c*)(i) above and thereby forming a nonacute angle with the floor member; and, (iv) being rigid enough to maintain the spaced apart relationship described in subparagraph 2(*c*)(iii); and, 3. the *above-recited* storage unit being located behind and having its first panel secured to the *above-recited* copyboard such that the first panel and copyboard converge at their upper ends like opposed sides of a pyramid.

A cooperative relationship exists between such copyboard and such storage unit attaining a unitary result the identity of which is collated storage of loose pages set aside from the copyboard. The relationships existing between the copyboard and storage unit implementing such unitary result are:

1. pages necessarily are positioned on the copyboard of a copyholder with the text side facing towad the typist—the copyboard therefore determines the nature as well as the initial position of the article (loose pages having text thereon) being supported on or in the invention combination and pages are held in such position (text side facing toward the typist) at the moment of removal from the copyboard—the copyboard therefore determines the position of such pages when received by the storage unit; therefore, the contribution made by the copyboard to such unitary result is that the copyboard determines the nature and position of the pages to be wet aside and thereby the purpose for which and the direction from which the invention storage unit is used;

2. the storage unit receives each page being set aside in such position and the forward inclination of the panels of the storage unit in cooperation with the downward inclination of the floor member causes each page to slide toward and come to rest leaning face down whereby subsequently set aside pages necessarily fall on top of and are located behind previously set aside pages, thereby retaining the original order of assembly of such pages as such order originally existed on the copyboard;

3. the second panel—by virtue of (x) having its upper end spaced well apart from the upper end of the first panel as described maintains the top of the storage compartment fully open and fully accessible from the direction of the copyboard whereby pages can easily be dropped into the storage compartment and (y) being at least as tall as the first panel, provides the forward side of its upper end accessible for use as a strike surface against which the typist aims the bottom edge of each page, such strike surface functioning to cause each page to enter the storage compartment behind the last set aside page and not interleaved between previously stored pages;

4. the nonacute angular relationship between the lower end of the second panel and the floor member precludes a corner in which the bottom edge of pages could get caught and cooperates with the downward inclination of the floor member to guide the bottom edge of pages away from the second panel and toward the first panel whereby clearance between pages and the second panel is maintained;

5. the first panel has its length related related to the length of the same given size of typewriter paper that is carried by the copyboard, the result of which is to make possible the attainment of the result described in subparagraphs 2 and 3 by precluding interference between any page on the copyboard and any page in the storage compartment that would block the openness of the storage compartment and accessibility of the second panel for use as a strike surface; and, 6. the first panel has its width related to the width of the same given size of typewriter paper that is carried by the copyboard, the result of which is to enable the typist to remove set aside pages quickly and easily by tapping them laterally out of the storage compartment.

A further object of the invention is to provide a copyholder/organizer as above described providing lateral adjustability of the copyboard for positioning same closer to the display screen of a desktop personal computer by rotation of the copyholder/organizer as a whole on the desktop, by providing:

(a) the copyboard having the underside of its shelf at the lowest elevation thereof spaced at least three inches above the desktop;

(b) an elongated planar base adapted to stand on a desktop, the base having forward and rearward ends and opposed sides extending symmetrically between the forward and rearward sides, the rearward end having a width substantially equal to the width of the storage unit, the forward end having a width no greater than one-half the width of the rearward end;

(c) the base having its rearward end only secured to the lower end of the storage unit, that portion of the base extending between such secured rearward end and its forward end extending forwardly from the lower end of the storage unit entirely free and unencumbered, the storage unit thereby providing the sole support for the copyboard by virtue of the attachment therebetween at their upper ends; and, (d) the base extending forwardly from the lower end of the storage unit under the center of gravity of the storage unit/copyboard combination, whereby, the storage unit and copyboard are fully supported without resort to weighting the base, the base having its forward end extending toward but ending substantially short of the shelf of the copyboard; whereby:

(i) when one side of the base is positioned in abutment against one end of the structure of such computer, a portion of the shelf overlies that end of the computer's keyboard and the copyboard as a whole is thereby positioned laterally closer to the computer's display screen than would otherwise be the case; and, (ii) an unobstructed space is provided under the copyboard extending fully to the lower end of the storage unit for placement of rider pages on the base.

A further object of the invention is to provide a copyholder/organizer as above described having it copyboard further elevated, (i) for location of the copyboard at an elevation substantially that of the display screen of a such computer, and (ii) to provide increased clearance under the copyboard's shelf for increased ease of placement and improved visibility of rider pages placed on the base, by providing structure extending upwardly between the rearward end of the base and the lower end of the storage unit that carries the floor member of the storage unit at an initial elevation as a consequence of which the copyboard is carried by the storage unit at a corresponding additional elevation.

A further object of the invention is to provide a foldable copyholder/organizer having all the features above described including elevation and lateral adjustability of the copyboard attained by the base means above described, by (i) providing the base and copyboard pivotally secured to the storage unit for overlapping foldability against the storage unit, (ii) providing means for locking the base in a given unfolded position that holds the storage unit forwardly inclined, and (iii) providing means for locking the copyboard in a given unfolded position that holds the copyboard rearwardly inclined.

A further object of the invention is to provide a foldable copyholder/organizer as above described in a construction that lends itself to manufacture substantially entirely of plastic yet is sturdy by an arrangement of ribs and other features, including a pushbutton device for locking the base into and releasing it from its unfolded position whereby excessive stress likely to crack the plastic is minimized, and including an all-plastic pivot and lock attachment of the copyboard onto the storage unit.

A further object of the invention is to provide a foldable copyholder/organizer as above described wherein the storage unit has a two-part molded plastic construction for moldability in relatively shallow molding dies, wherein the floor member is split so that a forward portion of the floor member is an integral part of the first panel and a rearward portion of the floor member is an integral part of the second panel, wherein the division between the forward and rearward portions of the floor member forms an irregular parting line for preventing the bottom edge of a page from becoming stuck in such parting line, and wherein means is provided for rigidly fastening the two portions of the floor member together to form a unitary storage unit.

A further object of the invention is to provide the storage unit providing first and second compartments, effected by first, second and third panels fixed to and rising from the floor member; the first compartment being defined by the first and second panels and floor member and used for setting aside draft pages as above described, and the second compartment being defined by the second and third panels and floor member and used for setting aside new printouts, the third panel bearing the same angular, proportional and functional relationship to the second panel as the second panel bears to the first panel.

BRIEF DESCRIPTION OF DRAWINGS

FIG. 4 is an exploded perspective view of the same embodiment.

FIG. 6 is a cross-sectional view, taken on the line 6—6 of FIG. 4, of a pushbutton lock/release device that is employed to lock the base in its unfolded position.

FIG. 7 is a view taken on the line 7—7 of FIG. 1, showing the copyboard in cross-section and the line-finder/paper fastener in side elevation.

FIGS. 8–12, inclusive, are reduced scale perspective drawings illustrating schematically five alternative embodiments of the invention copyholder.

FIG. 13 is a schematic top view of a desktop personal computer on a desktop with a schematic representation of the FIG. 1 embodiment the invention copyholder-/organizer in operative position at the left-hand side of the computer. The base of the copyholder/organizer is drawn in heavy solid outline and is fully shaded so that it stands out. Phantom lines, which appear to form a box around the base, represent the structure of the copyboard and storage unit that is supported by the base. The arrows indicate the line-of-sight of a seated typist—the vertical arrow pointing to the display screen of the computer's monitor, the diagonal arrow pointing not to the base but to the surface of of the copyboard.

FIG. 14 is an exploded perspective view of an alternative single-compartment embodiment of the storage unit, showing a split version of same, designed for moldability in relatively shallow molding dies.

DESCRIPTION OF PREFERRED EMBODIMENTS

Figure 1:
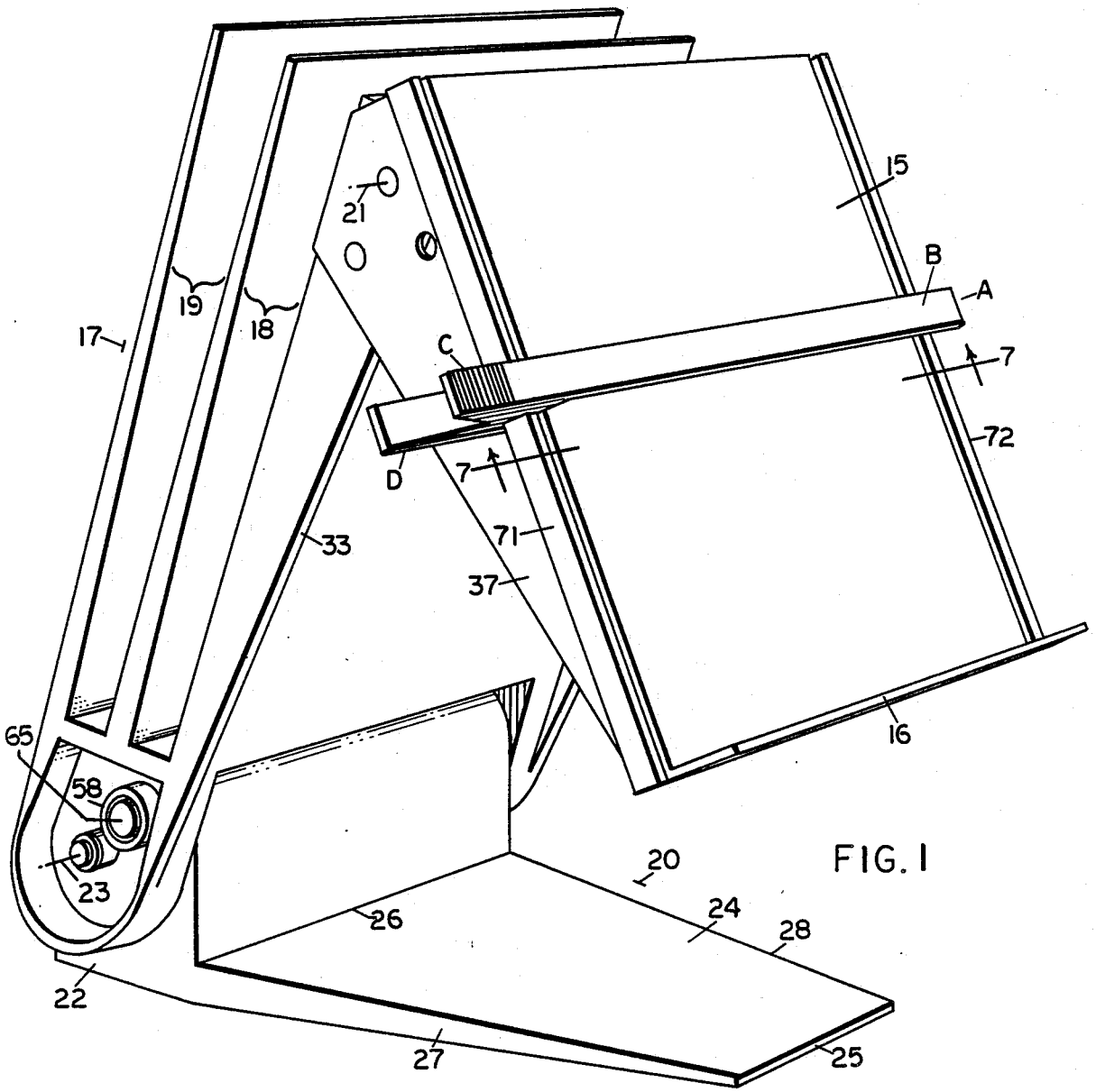
FIG. 1 is a general perspective view of the preferred embodiment of the invention copyholder/organizer, as it appears when unfolded, ready for use and with the presently improved linefinder/paper fastener in place on the copyboard.

Referring to FIG. 1 of the accompanying drawings, the invention copyholder/organizer includes a rearwardly inclined copyboard 15 the lower portion of which includes a shelf 16 for holding draft pages as is conventional practice. The essential novelty is the provision of a forwardly inclined storage unit indicated generally as 17 located behind the copyboard, the upper end of the storage unit being secured to the upper end of the copyboard so that the two converge like opposed sides of a pyramid. The essential feature of the storage unit 17 is the provision of at least one compartment for storage of set aside pages, but it is preferred that the storage unit provide two compartments, a first compartment 18 for setting aside draft pages removed from the copyboard 15 and a second compartment 19 for temporarily storing newly typed or printed pages (collectively, "printouts").

The embodiment shown in FIG. 1 includes an elongated base, indicated generally as 20, that provides the whole of the support needed to maintain the storage unit 17 at its forward inclination; the base 20 extending forwardly from the lower end of the storage unit so as to underlie the copyboard but being free of it. The copyboard 15 is thereby supported exclusively by the storage unit, the storage unit carrying the copyboard at an elevation spaced above the desktop on which the base rests.

In order to avoid a confusion of overlapping lines the drawings do not indicate transparency, but it is preferred that the copyboard and storage unit be made of a plastic that is transparent, so that, after completion of a typing assignment, any pages stored in the compartments of the storage unit will readily be seen through the copyboard, thereby precluding the possibility of forgetting pages in the storage unit. Alternatively, the copyboard and storage unit may be made of sheet metal and such visibility "through the copyboard" given effect either by cutting away a portion of such sheet metal at the upper end of the copyboard and forward panel(s) forming the storage unit, or, by providing the copyboard and forward panel(s) with holes that are aligned to afford a view into the compartment(s) of the storage unit. In any event, it will be obvious that for purposes of attainment of the invention, there is no need for the rearwardmost (i.e., located furthest from the copyboard) panel of the storage unit to be provided transparent or otherwise affording visibility through it. The base in the case of the illustrated plastic embodiment is preferably made of an opaque plastic in order to conceal internal elements, namely, the shaft around which it pivots and the device employed to lock it in its unfolded position.

Figure 5:
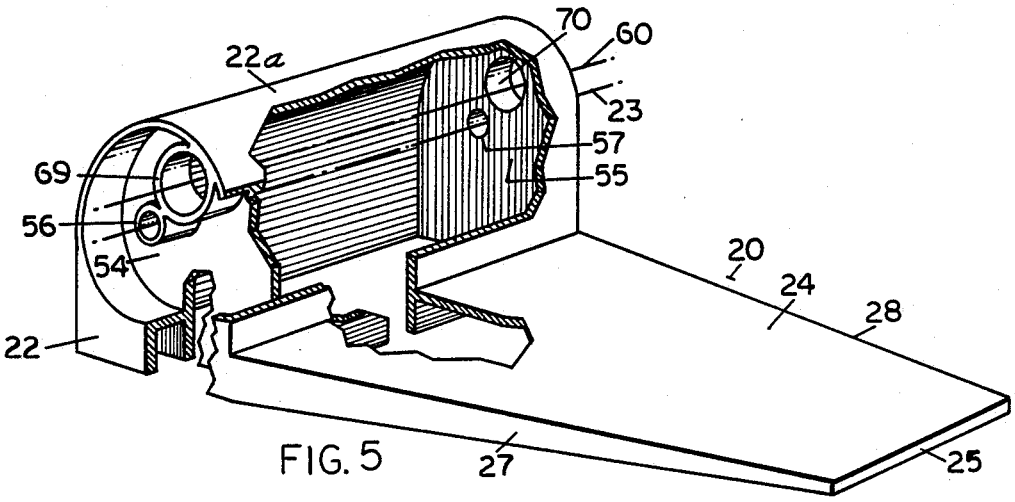
FIG. 5 is a broken part, perspective view of the base portion only of the same embodiment, drawn to the same scale as in FIG. 1.

In the embodiment shown in FIG. 1, the copyboard 15, the storage unit 17 and the base 20 are provided as one-piece plastic moldings which achieve lightness of weight and economy of manufacture, and, as will become evident when FIGS. 4 and 5 are considered, each of these major components has been provided in a form that lends itself to such mode of manufacture and is sturdy.

Continuing with reference to FIG. 1, in this preferred embodiment, the upper end of the copyboard 15 is pivotally secured to the upper end of the storage unit 17 for rotation around a copyboard pivot axis 21, and the rearward portion 22 of the base 20 is pivotally secured to the lower portion of the storage unit 17 for rotation around a base pivot axis 23 that lies parallel to the copyboard pivot axis 21. The base 20 is thereby effectively secured *at its rearward end 26 only* to the lower end of the storage unit so that no supporting structure extends between the base and storage unit forwardly of the lower end of the storage unit; i.e., the forward portion 24 of the base 20 is fully free and unencumbered by structure discouraging use of the forward portion 24 for placement of rider pages resting thereon; the forward portion 24 of the base 20 being provided substantially planar in form for resting a rider page on same.

The dictionary defines planar as, "existing in a single plane". If the forward portion 24 were made of metal, it could be made truly planar in the dictionary sense of the term, and such flat construction is shown in the alternative embodiments illustrated FIGS. 10, 11 and 12. But when the base 20 is constructed of plastic as in the case of the embodiment of the invention illustrated in FIGS. 1–4, as a practical matter it is necessary to provide stiffening ribs and such ribs unavoidably impart some measure of vertical dimension to the forward portion 24 of the base 20. In the interest of definiteness with respect to the appended claims, the language "sufficiently planar in form for resting a rider page on same" employed in the claims, is, for purpose of the present disclosure, hereby given the special meaning: "having its maximum vertical dimension not exceeding one-half inch".

The planar forward portion 24 of the base 20 is substantially narrower at its forward end 25 than at its rearward end 26, such that, when the copyholder/organizer is positioned on the desktop with one of the sides 27 or 28 of the planar forward portion 24 in abutment against one end of the structure (which structure may be either the central processing unit or the keyboard) of a desktop computer, a portion of the copyboard 15 and its shelf 16 will overhang that end of the computer's keyboard and thereby be positioned closer to the computer's display screen than would otherwise be the case. This result is attained by providing the forward end 25 of the base 20 having a width not exceeding one-half the width of the rearward end 26. The base, merely by virtue of being proportioned so much narrower at its forward end than at its rearward end, performs the function of enabling the copyboard to be positioned at a closeness to the computer's display screen that the prior art attains only by resort to additional, heavy and complex structure interposed between the copyboard and base.

The lateral adjustability of the copyboard provided by the invention base is shown in FIG. 13 wherein there is represented a desktop 75 on which rests a desktop personal computer including a central processing unit 76 upon which rests a monitor 77 having a display screen 78 in front of which is placed the computer's keyboard 79. To the left of the computer there has been placed the FIG. 1 embodiment of the invention copyholder/organizer having the base 20 the forward portion 24 of which has a forward end 25 the width of which is not greater than one-half the width of its rearward end 26. The side 28 of the base 20 is in abutment against one end of the central processing unit 76, causing the shelf 16 of the copyboard 15 to overlie the end 79*a* of the keyboard 79. The copyboard 15 is thereby positioned closer to the display screen 78 than would be the case if the base were square or rectangular or had a circular base the diameter of which equalled the width of the copyboard 15. The arrow 80 indicates the "straight ahead" line of sight of a typist seated at 81, and the arrow 82 indicates the typist's line of sight toward the copyboard 15. It is clear that the shape of the base enables the copyboard 15 to be positioned more squarely with respect to the arrow 82 than if the forward portion 24 of the base 20 were square or rectangular, and, that this advantage is provided *in combination with* the advantage of the copyboard 15 being positioned close to the display screen 78. The same result is, of course, obtained when the invention copyholder/organizer is placed at the right-hand end of the computer.

FIG. 13 demonstrates that:

(i) the shape of the base is not a matter of styling preference but performs the useful function of enabling lateral adjustability of the copyboard to be attained simply by rotating the copyholder/organizer as a whole on the desktop, whereby the copyboard is brought laterally closer to the display screen of the computer and is positioned at an angle more nearly square with the line of sight of the typist;

(ii) such functionally useful result has been attained without resort to any of the additional, heavy and complex structure interposed between the copyboard and base which characterizes prior art modes of attainment of such result;

(iii) such functionally useful result has been attained at zero increase in cost;

(iv) such functionally useful result has been attained without resort to means that might cause the copyboard to be shaky;

(v) such functionally useful result has been attained by means inherently sturdy; and, (vi) such functionally useful result has been attained by means the simplicity of which is applicable to and enables the art to provide—for the first time—a lightweight, portable copyholder offering lateral adjustability of the copyboard.

Figure 3:
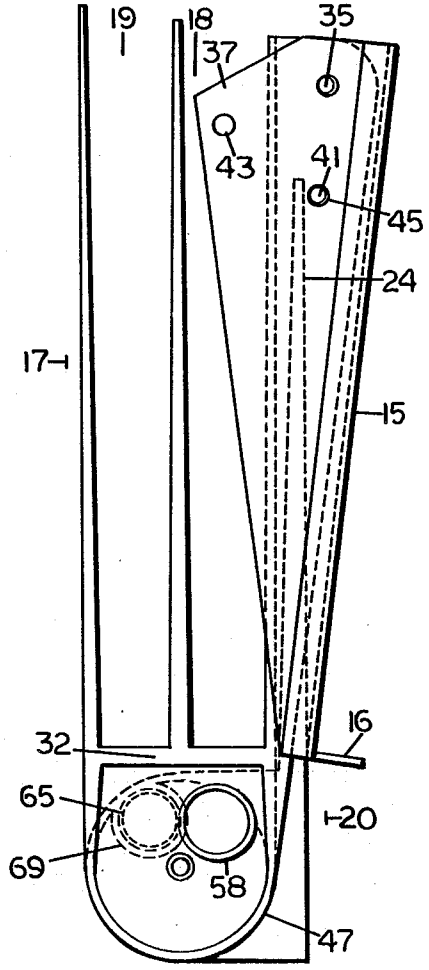
FIG. 3 is a side elevation drawn to the same scale as and similar to FIG. 2 except that FIG. 3 shows the copyholder/organizer as it appears when folded.
Figure 2:
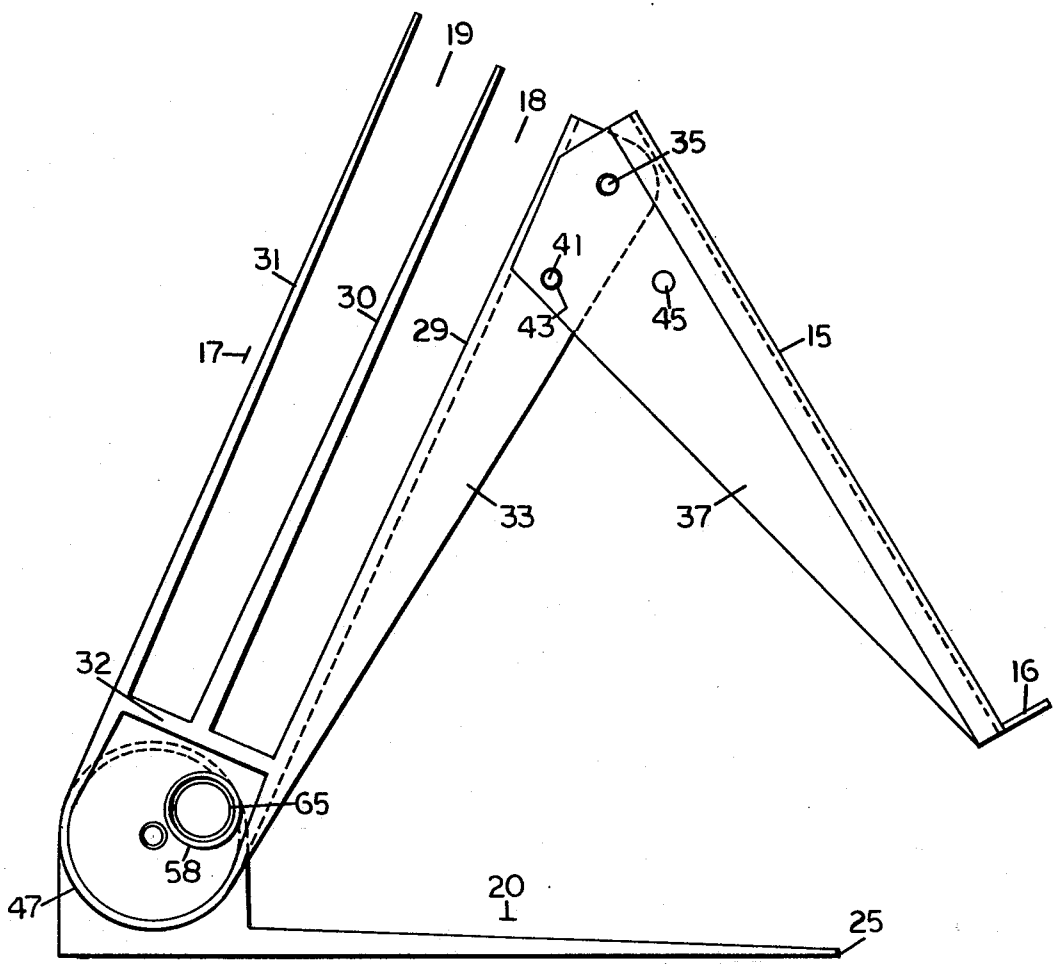
FIG. 2 is a reduced scale side elevation of the same but with the linefinder removed.

FIG. 2 is drawn to the same scale as FIG. 3 in order to facilitate comparison therebetween of the unfolded and folded proportions of the copyholder; FIG. 2 showing it as it appears when unfolded (as in FIG. 1) and FIG. 3 showing it as it appears when folded. As seen in FIG. 2, the shelf 16 is located not only spaced above but also extending well beyond the forward end 25 of the base 20. When the base is positioned as has been described above in abutment against one end of the structure of a desktop personal computer, the typist can pull the copyboard closer to himself for most comfortable use as desired; i.e., since the base is effectively set back, pulling the copyboard closer will not result in bringing the base too near the edge of the desktop—leaving that area of the desktop clear for use as an additional resting surface for rider pages supplementing the resting surface provided by the forward portion 24 of the base 20.

In FIG. 3 the storage unit 17 has been positioned upright, the base 20 has been pivoted upwardly so that its planar forward portion 24 is now folded against the storage unit, and the copyboard 15 has been pivoted downwardly so as to overlie the forward portion 24 of the base 20.

As seen in FIG. 2, in this embodiment the storage unit 17 is a one-piece plastic molding that includes first, second and third panels 29, 30, 31, respectively, that rise from a common floor member 32. The space effectively enclosed between the first and second panels 29, 30, respectively, and the floor member 32, defines the draft compartment 18, and the space effectively enclosed between the second and third panels 30, 31, respectively, and the floor member 32, defines the printout compartment 19.

It is preferred that the storage unit carry the copyboard as a whole at an elevation approximating that of the display screen of a desktop personal computer. To that end, the lower end of the storage unit 17 is preferably provided with structure depending from the lower end or floor member of the storage unit that places the floor member at an initial elevation, thereby elevating the copyboard without resort to increasing the length of the panels of the storage unit or increasing the rearward inclination of the copyboard. In a foldable embodiment such depending structure is convenient for pivotal attachment and securing of the base. Referring to FIG. 4, the lower end of the storage unit 17 is preferably molded to include a pair of spaced apart lugs 47, 48, that depend from the left-hand and right-hand sides, respectively, of the floor member 32; the lugs 47, 48, being positioned fore and aft and encompassing all of the panels of the storage unit so as to stiffen the floor member and thereby the storage unit in a fore and aft direction.

The first panel 29 is molded to include a pair of tapered panelribs 33, 34, that extend forwardly from the full length of its left-hand and right-hand sides, respectively; the panelribs 33, 34, extending downwardly into the lugs 47, 48, whereby the first panel 29 is in turn stiffened by drawing on the rigidity of the lugs. The outboard sides of the panelribs 33, 34, are molded to include copyboard pivot teats 35, 36, respectively, which are aligned on the copyboard pivot axis 21.

The storage unit 17 is constructed as rigidly as possible for general sturdiness and particularly in order that the openness of the compartments 18, 19, at the upper ends of the second and third panels 30, 31, respectively, shall be maintained for dropping pages freely into the compartments. Flexibility of the panels is undesirable, plays no constructive role, and, to the extent that it may exist if the panels are formed of sheet material—metal or plastic—bent to form the floor member and panels, should be compensated for either by forming ridges (effecting ribs) in such sheet material or by using sheet material thick enough to provide sufficient stiffness to ensure the desired openness of the compartments and offset the effect of gravity, which, in a thin sheet metal or thin sheet plastic construction, in view of the forward inclination of the panels, tends to cause the upper ends of the panels to fall closer together. FIGS. 1–4 show rigidity of the second and third panels 30, 31, respectively, having been obtained in a molded plastic construction by providing the panels substantially thicker at their lower ends than at their upper ends. FIG. 14 shows an alternative embodiment of the storage unit indicated generally as 17*f* providing a single storage compartment given effect by a first panel 29*f* and a second panel 30*a* wherein the second panel 30*a* is made rigid by means of ribs 83, 84, 85, located at the rearward side of the panel.

The copyboard 15 is preferably a one-piece plastic molding that includes a pair of tapered boardribs 37, 38, that extend rearwardly from the full length of the left-hand and right-hand sides, respectively, of the copyboard 15, whereby the copyboard is stiffened. When the copyboard 15 is assembled onto the storage unit, the boardribs 37, 38, are located outboard of the panelribs 33, 34, as seen in FIGS. 1 and 2 wherein the boardrib 37 is located outboard of the panelrib 33; the boardribs 37, 38, FIG. 4, being provided with copyboard pivot openings 39, 40, which receive the copyboard pivot teats 35, 36, respectively, so that the copyboard 15 is thereby pivotable on the copyboard pivot teats 35, 36, around the copyboard pivot axis 21.

Still referring to FIG. 4, the outboard sides of the panelribs 33, 34, are molded to include copyboard lock teats 41, 42, respectively, which are received in a first pair of copyboard board lock openings 43, 44 that are provided in the boardribs 37, 38, respectively, for locking the copyboard in its raised or unfolded position as shown in FIGS. 1 and 2, and alternatively, are received in a second pair of copyboard board lock openings 45, 46 that are provided in the boardribs 37, 38, respectively, for locking the copyboard in its lowered or folded position as shown in FIG. 3.

The copyboard is released for folding or unfolding by grasping the boardribs 37, 38, and pulling them apart just enough to effect their release from the copyboard lock teats 41, 42; the copyboard being molded of a plastic having sufficient inherent flexibility, or, the boardribs 37, 38, being made thin enough, or both, for this purpose; the substantial width of the boardribs 37, 38 at their upper ends facilitating obtaining a grip for pulling them apart. Of course, in order to ensure the desired result without disengaging the copyboard from the pivot teats 35, 36, the pivot teats must be proportioned as long as possible consistent with being able to assemble the copyboard by snapping the boardribs 37, 38, onto the copyboard pivot teats, and the copyboard lock teats 41, 42 must be proportioned as short as possible, i.e., just barely long enough to engage the copyboard lock openings 43, 44, or, alternatively, the copyboard lock openings 45, 46, to stop the rotation of the board. This is evident in FIG. 4 in which the copyboard pivot teats 35, 36 are shown as being longer than the copyboard lock teats 41, 42.

Still referring to FIG. 4, the lugs 47, 48, are molded to include a first pair of shaft bearings 49, 50, respectively, which are aligned on the base pivot axis 23 and through which a shaft 51 will be journaled and secured with end caps 52, 53, after assembly of the base 20 between the lugs 47, 48.

Referring to FIG. 5, which shows the base 20 with portions broken away, the rearward portion 22 of the base 20 is molded to include a pair of spaced apart upright members 54, 55, which include a second pair of shaft bearings 56, 57, respectively, through which the shaft 51, FIG. 4, extends when the rearward portion of the base is positioned between the lugs 47, 48; the bearings 56, 57, FIG. 5, being then, of course, aligned on the base pivot axis 23. In order to enhance the appearance of the base, the upright members 54, 55, are preferably molded as part of a housing or enclosure **22*a*** that conceals the elements located within the base.

Referring again to FIG. 4, the lugs 47, 48, are molded to include a pair of storage unit lock openings 58, 59, respectively, which are aligned on a base lock axis 60. A pushbutton lock/release device indicated generally as 61 is provided that will be assembled into the rearward portion of the base prior to installation of the base between the lugs 47, 48. FIG. 6 shows the pushbutton lock/release device 61 enlarged and in cross-section, where it is seen as comprising two slidably engaged tubes 62, 63, which house an expansion spring 64. The free ends of the tube 62, 63, are closed and reduced in diameter to form pushbuttons 65, 66, having shoulders 67, 68, respectively. (Note: The combination of elements comprising the device 61 is old in another art, having long served as an expandable rod to support rolled tissue in a holder.) In order to receive the pushbutton lock/release device, the upright members 54, 55, FIG. 5, are molded to include a pair of open-ended sleeves 69, 70, respectively, for carrying the end portions (immediately inboard of the pushbuttons) of the tubes 62, 63. The storage unit lock openings 58, 59, FIG. 4, are large enough in diameter to accept only the pushbuttons 65, 66, and not the relatively larger diameter of the main body of the tubes 62, 63; as a result, after assembly of the base between the lugs 47, 48, the lock/release device 61 remains confined between the sleeves 69, 70, FIG. 5, of the base 20. The free length of the lock/release device 61 is such that compression is required for its installation between the lugs 47, 48, FIG. 4, so that the spring 64 normally keeps the pushbuttons 65, 66, pressed against the lugs 47, 48; the shoulders 67, 68, FIG. 6, of the pushbuttons 65, 66, limiting the depth of entry of the pushbuttons into the storage unit lock openings 58, 59, FIG. 4.

The user locks the base into its unfolded position by rotating it until the pushbuttons 65, 66, snap into the storage unit lock openings 58, 59, respectively, as seen in FIGS. 1 and 2 which show pushbutton 65 engaged in storage unit lock opening 58 of lug 47. The storage unit 17 is thereby locked at its forward inclination in a manner well able to support its loaded weight because the pushbutton lock/release device is effectively a bar that extends through the storage unit and the base, and stress on the plastic components is minimized by distribution around the substantial circumference of the two pushbuttons.

At any other rotated position of the base the pushbuttons 65, 66, merely abut against the closed inboard surfaces of the lugs 47, 48, as indicated in FIG. 3 which shows the base folded and dashed lines representing the now hidden pushbutton 65 withdrawn into the now hidden sleeve 69 of the base.

The base is unlocked and folded by holding it between both hands and depressing the pushbuttons simultaneously—using one's middle fingers—while pushing the planar forward portion of the base upwardly with one's thumbs; the pushbuttons of course being depressed far enough to disengage them from the lugs so that the base is free to pivot; the base being folded first so that the copyboard overlies the base, because, in this embodiment, the shelf 16 is fixed in position with respect to the board portion of the copyboard. Attainment of increased compactness is anticipated by provision of an alternative embodiment of the copyboard (not shown) wherein the shelf 16 is pivotally secured to so as to be foldable against the copyboard, means being provided to stop such shelf at its unfolded position; using such alternative embodiment of the copyboard, the copyboard can be folded first and the base folded overlying the copyboard.

Referring to FIGS. 1 and 4, the outboard sides of the boardribs 37, 38, are preferably molded to include guide rails 71, 72, respectively, that extend the full length of the boardribs and provide directly opposed grooves as at 73, 74, with repect to guide rail 72 in FIG. 7. The guide rails enable attachment by nonmagnetic means of a combination linefinder/paper fastener, indicated generally as A in FIGS. 1 and 7, optionally, to either the left-hand guide rail 71 or the right-hand guide rail 72.

Referring to FIG. 7, which shows the linefinder A in side elevation on a cross-sectional view of the copyboard 15, the linefinder/paper fastener A is a one-piece flexible plastic molding that provides a ruler B having a flexible clamp formed at one end; the clamp comprising opposed levers C, D, having directly opposed jaws E, F, respectively, that are adapted to fit into the directly opposed grooves of either of the guide rails. The clamp has a reduced mass at G that enables the clamp to flex and thereby serve as a fulcrum for the levers C, D, whereby, squeezing the levers together results in a corresponding opposite movement of the jaws E, F, that releases their grip on the guide rail on which they are applied. The directly opposed relationship between the jaws E, F, enables them to secure a grip on the guide rail that enables the ruler B to be supported spaced apart from the copyboard so as to provide a clearance H for accepting a thick document, or, for enabling pages to be removed without disturbing underlying pages.

The embodiment of the invention copyholder/organizer illustrated in FIG. 1 (supported by FIGS. 2–6) is preferred because it provides a combination of features which it is believed will be of value to the greatest number of user; namely, storage capability for both completed draft pages and new printouts combined with an elevated and laterally adjustable copyboard, provision for placement of rider pages and attachment of a nonmagnetic linefinder/paper fastener, all within the context of an economical molded plastic, desktop standing construction that is foldable to proportions compact enough for storage or portable use.

FIGS. 8–12, next described, illustrate five alternative embodiments within the intended scope of the appended claims.

Each of the embodiments illustrated in FIGS. 8–12 is shown having a storage unit that provides only one compartment, it being obvious that each can be provided in an alternative form having a second compartment.

FIGS. 8–12 are drawn to the same scale in order to provide visual support for comparison made in the following description between the several embodiments with respect to relative overall size and angles of the storage unit and copyboard.

FIG. 8 anticipates a nonfoldable copyholder/organizer in which the copyboard 15*a* is rigidily secured to the storage unit 17*a* and in which the copyboard and storage unit both stand directly on the desktop.

FIG. 9 anticipates a foldable version of the FIG. 8 embodiment; specifically, in which the copyboard 15*b* is pivotally secured at 21*b* to the storage unit 17*b* and in which the copyboard and storage unit both stand directly on the desktop.

FIG. 10 anticipates another nonfoldable embodiment in which the copyboard 15*c* is rigidly secured to the storage unit 17*c* and in which the storage unit 17*c* stands directly on the desktop, but in which the storage unit is supported by a planar base 20*c* that is rigidly secured to the storage unit. FIG. 10 anticipates the copyboard being elevated by means of having been provided with an increased rearward inclination (compare the reward inclination of the copyboard 15*c* of FIG. 10 with that of the corresponding element in FIGS. 8 and 9). FIG. 10 further anticipates the copyboard as a whole being elevated by means of the storage unit being made taller; i.e., the panel 29*c* in FIG. 10 is taller than panel 29*a* of FIG. 8 or panel 29*b* of FIG. 9.

FIG. 11 anticipates a foldable version of the FIG. 10 embodiment. In the FIG. 11 embodiment the copyboard 15*d* is pivotally secured to the storage unit 17*d* at 21*d* and the base 20*d* is pivotally secured to the storage unit 17*d* at 23*d*. FIG. 11 further anticipates a pivotal attachment of the base to the forward side of the storage unit (as opposed to being attached underneath the storage unit as in the case of the preferred embodiment of the invention (FIGS. 1–4)).

FIG. 12 is another nonfoldable embodiment similar to FIG. 10 but anticipating a further elevation of the copyboard 15*e* as a whole by provision of structure 22*e* that places the floor member 32*e* of the storage unit 17*e* at an initial elevation, the structure 22*e* extending between and rigidly securing the storage unit 17*e* to the base 20*e*.

Referring now to FIG. 14, there is shown an alternative, single-compartment, two-section embodiment of the invention storage unit, each section of which is designed for moldability in relatively shallow molding dies and user assembly after purchase.

Such effectively split storage unit, the two sections of which are indicated collectively as 17*f*, comprises a forward section indicated generally as 86 and a rearward section indicated generally as 87. Except for features implementing such two-section construction and being limited to providing a single compartment, the construction is much the same as the embodiment of FIGS. 1–4, particularly as seen in FIG. 4, with which the embodiment of FIG. 14 should be compared. The structure shown in FIG. 14 is intended for use in direct substitution for the storage unit 17 of FIG 4. and all the other components shown in FIG. 4 are incorporated by reference into FIG. 14 for use in combination with the storage unit 17*f* in the same manner as such components have been described for use with the storage unit 17 of FIG. 4; *except that*, for use with the storage unit 17*f* of FIG. 14, the base 20 (see FIG. 5) must have its sleeves 69, 70 effectively rotated about the axis 23 so as to be located at a position more nearly above the shaft bearings 56, 57, respectively, so that the base as so modified will support the storage unit 17*f* at the same forward inclination that has been given to the storage unit 17 in FIG. 2. (This requirement applies only to the embodiment illustrated in FIG. 14 which, as a matter of preference, provides the lug halves coming together along a straight, vertical parting line.)

The forward section 86, FIG. 14, provides a first panel 29*f* having panelribs 33*a*, 34*a*, which are equivalent to the panelribs 33, 34, of the FIG. 4 embodiment; and each of the panelribs 33*a*, 34*a*, is provided with a copyboard pivot teat as at 35*a*, and a copyboard lock teat at a 41*a* having its counterpart and serving the same purpose as previously described in connection with FIG. 4 for attachment of the copyboard 15 of FIG. 4 without modification of the latter.

The floor member 32 of FIG. 4 has, in FIG. 14, effectively been split to comprise forward and rearward portions 32*a*, 32*b*, respectively, which are to be fastened together, in this case, by a carriage bolt 88 that is passed through openings 89, 90, provided in the forward and rearward sections 86, 87; the bolt 88 being secured by a nut 91. The floor member portions 32*a*, 32*b*, have an irregular parting line here given effect by protrusions as at 92 provided on the rearward floor member portion 32*b* which enter into recesses as at 93 provided in the forward floor member portion 32*a*; the irregular parting line thereby effected serving the purpose of preventing pages from sticking between the forward and rearward portions of the floor member.

The first panel 29*f* rises squarely from the forward floor member portion 32*a* so that pages will stack squarely on the assembled floor member.

The rearward section 87 provides a second panel 30*a* that rises from and forms an obtuse angle with the rearward floor member portion 32*b* whereby the first and second panels are spaced substantially further apart at their upper ends than at their lower ends.

As in the case of the FIG. 4 embodiment wherein lugs 47, 48, are provided depending from the floor member 32 for pivotal attachment of the base 20, in the embodiment of FIG. 14, the forward section 86 provides forward lug halves 47*a*, 48*a*, after assembly, will close against rearward lug halves 47*b*, 48*b*, that are provided by the rearward section 87. Secure closure is assisted by provision of tapered teats 99, 94, on the forward lug halves 47*a*, 48*a*, which jam into openings 95, 96, provided in the rearward lug halves 47*b*, 48*b*, respectively. Alternatively, means may be provided effecting an interlocked, snapped-together mode of attachment between the forward and rearward sections of the storage unit 17*f*.

As in FIG. 4 wherein the lug 47 provides a shaft bearing 49 and a storage unit lock opening 58, likewise in FIG. 14, the corresponding lug halves 47*a*, 47*b*, provide a split equivalent of the same elements. In FIG. 14, the forward/rearward lug halves 47*a*, 47*b*, provides forward/rearward shaft bearing halves 49*a*, 49*b*, and forward/rearward storage unit lock opening halves 58*a*, 58*b*, respectively. Obviously, the lug halves 48*a*, 48*b*, duplicate the shaft bearing and lock opening elements provided by its counterpart, obviating the necessity for further description.

Finally, the rearward side of the second panel 30*a* is provided with tapered ribs 83, 84, 85, which rise at their greatest width from a rearward extension 97 of the rearward portion 32*b* of the floor member—thereby providing the most rigid construction with the least quantity of material.

Additional Remarks

The manufacturer of one well-known brand of copyholder provides the copyboard fixed at an angle of 60 degrees; the angle referred to, to course, being that acute angle that is included between the plane surface of the copyboard and a horizontal desktop. This inventor has long used such copyholder and finds such angle to be optimum because:

(i) it keeps pages leaning against the board instead of tending to curl off the shelf; and, (ii) does not cause excessive glare to be reflected from overhead lighting; yet, (iii) it is upright enough that text is comfortable to read.

But not all manufacturers provide the copyboard rearwardly inclined at 60 degrees; the inclination of fixed-angle copyboards will vary from one brand of copyholder to another, with corresponding decrease in the functions listed above in proportion to the extent of variance. Of course, what constitutes an optimum angle is to some extent a matter of the personal preference of the user of the copyholder. Some conventional copyholder provide the copyboard adjustable so that the user can determine such optimum angle. Experimentation with such an adjustable copyholder indicates, however, that 60 degrees is a useful reference and that when the variance from 60 degrees is greater than 15 degrees plus or minus, the adverse effects are so clearly noticeable that it may be said that the useful range of rearward inclinations is from 45 to 75 degrees.

Of course, it is still possible to use a copyboard at a rearward inclination other than between the range of 45 to 75 degrees, but, (i) since no conventional fixed-angle copyboard has been found having an angle exceeding such limits, (ii) to further define the meaning of the term "copyboard" recited in the appended claims and (iii) in order to exclude art outside the field of the invention providing a board and shelf at rearward inclination not suited for use as the copyboard of copyholder (as evidenced by the copyholder industry not providing fixed-angle copyboards having more extreme inclinations which would be either so flat as to negate the reason for using a copyholder or so upright as to be unsuitable for keeping loose pages from falling off), the position is taken herein that 60 degrees plus or minus 15 degrees defines the rearward inclination of the copyboard of a copyholder.

Considering another aspect, conventional copyholders provide the shelf of the copyboard measuring anywhere from ⅝ths of an inch to 1 inch in depth. The invention contemplates providing the shelf 16 having a depth of 1 inch to support a recommended given maximum number of loose pages accumulating to a thickness of about ¾ths of an inch. The storage unit must therefore have its panels spaced apart far enough to contain such thickness of pages, but also spaced an additional distance further apart in order to provide sufficient clearance for freely dropping the last of such of pages into the storage compartment. Such clearance must be ample enough that there is no need for the typist to make special effort to insert the last or the last few of such pages into the storage unit and is able to drop pages into the storage compartments without hesitation and without having to use one hand to squeeze the prviously set aside pages together to increase such clearance while the other hand drops the next page into place. A clearance of ¼ inch—*at the lower ends of the panels*—remaining after the last of such ¾ inch thickness of pages has been set aside is sufficient to accomplish the intended purpose. Accordingly, since the ability to contain a ¾ inch thickness of pages provides a reasonable storage capacity (i.e., related to and "reasonable" in the sense of being equal to or greater than the number of pages held on the copyboard at any one time) and a remaining clearance of ¼ inch is desired, it is preferred that adjacent panels be spaced apart at their lower ends at least 1 inch.

A wider spaced apart relationship between the lower ends of the panels becomes increasingly undesirable because it has the substantial adverse effect of permitting pages to come to rest bowed instead of standing substantially straight. This factor can be appreciated by exaggerating the circumstances and imagining a page having a length of 11 inches dropped between panels spaced 11 inches apart at their lower ends. Obviously, nothing would preclude such page from coming to rest flat on the floor member instead of standing against the forward panel. Using half such extreme spacing, the page would come to rest considerably bowed. A quantity of pages stored one on top of the other in such bowed condition would be awkward to remove and require substantial tapping to restore to evenly stacked condition. Accordingly, to the extent that the spaced apart relationship of the lower ends of the panels exceeds what is essential to accomplish the purpose of the invention there will be undersirable bowing of pages in the storage compartment. It is necessary therefore to reasonably limit the spaced apart relationship provided at the lower ends of the panels. The panels should be spaced apart at their lower ends no more than 1½ inches in order to acceptably limit the bowing of pages and keep them straight enough that they tend to stand on the floor member and slide downwardly thereon toward the forward panel of the storage compartment.

The above discussion has shown that due to the nature of the article which the invention storage unit is intended to contain, namely, loose sheets of paper having inherent flexibility (as opposed to a solid or substantially solid object such as a bound book which is inherently stiff), which inherent flexibility permits such sheets of paper to come to rest bowed unless confined so as to preclude bowing, there is a practical limit to the maximum spaced apart relationship that can be provided between the lower ends of the panels and still give physical expression to the result conceived. The invention storage unit thereby further distinguishes from the construction disclosed by Mathias in U.S. Pat. No. 3,809,352, wherein, the lower ends of the "holding and viewing panel" on the one hand and the "book-supporting panel" on the other hand, can be spaced almost as far apart as the book is tall.

In further contrast to the construction disclosed by Mathias wherein the upper end of the holding/viewing panel converges toward the upper end of the book-supporting panel and clamps against the pages of the opened book so as to hold such pages flat; i.e., zero clearance is provided between the holding/viewing panel and the book and such zero clearance (in fact, clamping pressure) is necessary in order to give physical expression to the result conceived (being that of holding the pages flat), in the present invention a clearance of at least ¼ inch is essential and greater clearance is much to be desired in order (i) to enable pages to be freely dropped into the storage compartment and (ii) to provide the forward side of the secondary panel of a given storage compartment as accessible as possible for use as a strike surface.

For example, if other considerations permitted doing so, no harm would result and the results obtained would be enhanced if the panels of the invention storage unit were spaced twice as far apart at their upper ends than at their lower ends; whereas, in the case of the construction disclosed by Mathias, divergence of the upper end of the holding/viewing panel away from the upper end of the book-supporting panel would be contrary to the recited language of the claims of his patent and defeat the primary purpose of his device.

A two-compartment embodiment of the invention storage unit tends to limit the extent to which the panels can be provided spaced further apart at their upper ends than at their lower ends becaue undesirable bulkiness is thereby introduced and it is desired to keep the forwardmost panel of each compartment rising substantially squarely from the floor member; but should be and is in the accompanying drawings shown to have been provided to the extent practicable. As seen in FIGS. 1–4, the upper ends of the second and third panels 30, 31, respectively, are substantially thinner at their upper ends than at their lower ends; thereby simultaneously attaining two objectives of the invention: (i) to provide the panels as rigid as possible and (ii) to provide all three panels spaced further apart at their upper ends than at their lower ends.

A single-compartment embodiment of the invention storage unit may readily provide its first and second panels spaced much further apart at their upper ends than at their lower ends. It is not obvious in FIG. 14 due to the nature of perspective drawings, but the single-compartment embodiment of storage unit shown in FIG. 14 in fact has the first and second panels **29*f*, 30*a*, respectively, spaced substantially further apart at their upper ends than at their lower ends; as can be acertained by measuring horizontally across the figure—the first panel 29*f* forming a 90 degree angle with the forward portion 32*a* of the floor member (so that pages will stack squarely) and the second panel 30*a* forming an obtuse angle with the rearward portion 32*b*** of the floor member.

I claim:

1. For placement alongside a typewriter or desktop personal computer to support a multipage document existing on a given standard size of typewriter paper having a given width and given length and comprising loose pages having a given collation which are marked for revision and are to be set aside sequentially as revisions are completed:

a typist's copyholder/organizer proportioned for said placement and use with said given standard size of typewriter paper and providing means for storing set aside pages in a manner that retains their collation; comprising:

a rearwardly inclined copyboard having upper and lower ends and a shelf projecting forwardly from its lower end for support of a given number of said loose pages; said copyboard having a given length as measured from its extreme upper end to said shelf at least equal to the length of said papers;

a forwardly inclined storage unit provided behind said copyboard for containment of set aside pages; said storage unit having upper and lower ends and comprising a floor member and first and second panels; said panels having upper and lower ends and forward and rearward sides, being spaced apart as hereinafter recited and having their lower ends fixed to said floor member, said floor member being flat and intersecting said first panel substantially perpendicularly;

the space effectively enclosed between said panels and floor member defining a storage compartment having an open top and laterally opposed open sides, to allow pages to be quickly dropped into said compartment utilizing its open top in combination with either one of its open sides, and pages to be removed by sliding them laterally out of said compartment through either one of its opposed open sides, in each mode of use said storage unit thereby providing left-handed/right-handed user convenience;

means effecting a cooperative relationship between said storage unit as defined above and said copyboard as defined above, such that as a natural consequence of pages being removed from said copyboard with the text side facing the typist each page dropped into said compartment necessarily comes to rest leaning face down toward the inboard of said first panel, comprising, the upper end of said copyboard being secured to the upper end of said first panel so they converge like opposed sides of a pyramid and said storage unit as a whole is thereby forwardly inclined;

means preventing interference between the top edge of any page stored in said compartment and the top edge of any page resting on said copyboard, comprising, said first panel having a given length as measured from its extreme upper end to said floor member at least equal to the length of said paper;

means providing a strike surface toward which the typist aims the lower edge of each page being set aside so as to cause each page necessarily to enter said compartment behind the last stored page, comprising:

said panels being spaced apart at their lower ends a given distance great enough for said compartment to receive said given number of pages with sufficient clearance remaining between the last of said pages and the foward side of said second panel for such last page to fall freely to said floor member;

said panels being spaced apart at their upper ends a distance at least equal to the distance which said panels are spaced apart at their lower ends;

said second panel having a given length as measured from its extreme upper end to said floor member at least equal to the length of said first panel; and, as a consequence of the forward inclination of said storage unit, said floor member being inclined downwardly toward said first panel and thereby causing the bottom edge of set aside pages to tend to slide toward said first panel and thereby maintain said clearance;

means providing set aside pages quickly removable through one of the opposed open sides of said compartment by tapping them out from the opposite open side, comprising, said first panel having a width at least a portion of which is less than the width of said paper.

2. A copyholder/organizer providing its copyboard elevated and the area under same clear for placement of rider pages and providing lateral adjustability of the copyboard for positioning same close to the display screen of a desktop personal computer by rotation of the copyholder/organizer as a whole on the desktop; comprising, in combination with the subject matter of claim 1:

a nonweighted base adapted to rest on a desktop, said base including an elongated planar portion sufficiently planar in form for resting a rider page on same;

said planar portion having a rearward end that is wide enough to provide lateral support for both said storage unit and said copyboard, a forward end having a width no greater than one-half the width of its rearward end, and opposed sides extending symmetrically between said forward and rearward ends;

means securing the rearward end only of said planar portion to the lower end of said storage unit such that said planar portion is free and said storage unit is maintained at its forward inclination solely by said base;

said storage unit providing the sole support for said copyboard and supporting said copyboard at its rearward inclination and such that its shelf is spaced at least three inches above said desktop;

said planar portion extending forwardly from the lower end of said storage unit so as to underlie but being free of said copyboard and providing full support of the storage unit/copyboard subcombination by extending under the center of gravity of same, said planar portion having its forward end terminating rearwardly of said shelf; whereby:

an unobstructed space is provided under said copyboard overlying said planar portion, said space extending from a point under said shelf rearwardly therefrom fully to the lower end of said storage unit for placement of rider pages resting on the planar portion of said base; and, when said copyholder/organizer as a whole is rotated so that one side of said planar portion of said base is positioned in abutment against one end of the structure of said computer, a portion of said copyboard's shelf overlies that end of the computer's keyboard and said copyboard as a whole is thereby positioned laterally closer to the computer's display screen than would be possible if the forward end of said planar portion were not provided having said width.

3. A portable copyholder/organizer; comprising, in combination with the subject matter of claim 2:

means pivotally securing the rearward end of the planar portion of said base to the lower end of said storage unit for rotation of said planar portion about a base pivot axis, providing an unfolded position of said base wherein said storage unit is positioned at its forward inclination and an alternate folded position of said base wherein the forward end of its planar portion is located near the forward side of said first panel;

base lock means adapted to lock said base in said unfolded position, and alternatively, to release said base for folding;

means pivotally securing the upper end of said copyboard to the upper end of said first panel for rotation of said copyboard about a copyboard pivot axis, providing an unfolded position of said copyboard wherein it is positioned at its rearward inclination and an alternate folded position of said copyboard wherein its shelf is located near the forward side of said first panel;

copyboard lock means adapted to lock said copyboard in said unfolded position, and alternatively, to release said copyboard for folding;

the pivotal axes of said copyboard and base being located such that said copyboard and said planar portion fold one overlapping the other.

4. A portable copyholder/organizer; comprising, in combination with the subject matter of claim 2:

the lower end of said storage unit being provided with a pair of lugs depending from said floor member and laterally spaced apart under same; said lugs extending fore and aft of said floor member so as to encompass said panels for stiffening said floor member and reinforcing a pair of tapered panelribs provided extending forwardly from laterally opposed edges of said first panel and continuing downwardly into said lugs whereby said first panel is in turn stiffened, said panelribs having their greatest width at the upper end of said first panel;

said base being provided having a rearward portion distinct from said planar portion and providing a pair of upright members which are laterally spaced apart to stand adjacent said lugs;

means pivotally securing said upright members to said lugs for rotation of the planar portion of said base about a base pivot axis that extends through said lugs and upright members, providing an unfolded position of said base wherein said storage unit it is positioned at its foward inclination and an alternate folded position of said base wherein the foward end of its planar portion is located near the forward side of said first panel;

base lock means arranged between said lugs and upright members, adapted to lock said base in said unfolded position, and alternatively, to release said base for folding;

said copyboard being provided including a pair of tapered boardribs that extend rearwardly from laterally opposed edges of said copyboard whereby said copyboard is stiffened, said boardribs having their greatest width at the upper end of said copyboard and being located outboard of said panelribs;

means pivotally securing said boardribs to said panelribs for rotation of said copyboard about a copyboard pivot axis, providing an unfolded position of said copyboard wherein it is positioned at its rearward inclination and an alternate folded position of said copyboard wherein its shelf is located near the forward side of said first panel;

copyboard lock means arranged between said boardribs and said panelribs adapted to lock said copyboard in said unfolded position, and alternatively, to release said copyboard for folding.

5. A portable copyholder/organizer as in claim 4 wherein:

said upright members stand between said lugs;

said base lock means comprises said lugs being provided with a pair of storage unit lock openings aligned on a base lock axis located parallel to and spaced apart from said base pivot axis, said upright members being provided with a pair of open-ended sleeves aligned on said base lock axis, and a pushbutton lock/release device being provided comprising two telescoping tubes and an expansion spring extending longitudinally inside the tubes, said tubes having free ends which are closed and reduced in diameter to form pushbuttons having shoulders, the pushbuttons being normally impelled apart along the longitudinal axis of said tubes under the bias of said spring, said device being installed between said upright members by means of end portions of said tubes between the shoulders thereof being journaled in said sleeves, the inside diameter of said sleeves being large enough to accommodate said end portions but said storage unit lock openings having a relatively smaller diameter large enough to accommodate only said pushbuttons.

6. A portable copyholder/organizer as in claim 4 wherein:

the means pivotally securing said boardribs to said panelribs comprises a pair of copyboard pivot teats that are provided on one pair of ribs aligned on said copyboard pivot axis and that register in copyboard pivot openings provided in the other pair of ribs;

said copyboard lock means comprises a pair of copyboard lock teats provided on one pair of ribs spaced apart from the copyboard pivot teats, and which copyboard lock teats register, alternatively, in first and second pairs of copyboard lock openings provided in the other pair of ribs, the copyboard lock openings on each given rib being located at a common radius from their cooperating lock teat and arcuately spaced apart to effect said folded and unfolded positions of said copyboard at each of which positions said copyboard is locked when the copyboard lock teats enter into the copyboard lock openings, and, said boardribs being manually flexible outboardly away from said panelribs, such that, by manually pulling the boardribs apart the copyboard lock teats are caused to become disengaged from the currently engaged copyboard lock openings, thereby permitting rotation of the copyboard around said copyboard pivot teats for engagement of said copyboard lock teats in the other pair of copyboard lock openings;

the combination being so constructed and arranged that said copyboard is foldable overlying the planar forward portion of said base, as a result of which, when said copyboard is locked in its folded position the base is likewise secured.

7. A portable copyholder/organizer as in claim 5 wherein:

the means pivotally securing said upright members to said lugs comprises said lugs being formed to provide a first pair of shaft bearings, said upright members being formed to provide a second pair of shaft bearings, and a shaft being provided that extends through said first and second pairs of shaft bearings;

said storage unit comprises distinct forward and a rearward sections divided on a parting plane that splits said floor member and said lugs into forward and rearward halves, the forward half of said floor member and lugs being molded integrally with said first panel, the rearward half of said floor member and lugs being molded integrally with said second panel;

means for rigidly fastening said forward and rearward sections together to form a unitary storage unit;

said parting plane dividing said floor member irregularly to prevent pages from becoming stuck between the forward and rearward halves of said floor member;

said parting plane dividing said lugs such that said first pair of shaft bearings and said storage unit lock openings are divided into equal halves.

8. For placement alongside a typewriter or desktop personal computer to support a multipage document existing on a given standard size of typewriter paper having a given width and given length and comprising loose pages having a given collation which are marked for revision and are to be set aside sequentially as revisions are completed:

a typist's copyholder/organizer proportioned for said placement and use with said given standard size of typewriter paper and providing means for storing set aside pages in a manner that retains their collation; comprising:

a rearwardly inclined copyboard as used in a conventional typist's copyholder for support of a document existing on a given standard size of typewriter paper having a given width and given length and comprising a plurality of loose pages; said copyboard having upper and lower ends and including a shelf projecting forwardly from its lower end sharply enough that pages do not tend to slide off said shelf;

said copyboard being inclined at an angle suitable to keep said pages leaning on said copyboard while supporting said pages upright enough that said pages can comfortably be read by a typist seated at a typewriter or desktop computer;

said shelf being deep enough to support a given maximum number of said pages; and, said copyboard having a length as measured from its extreme upper end to said shelf at least equal to the length of said paper;

a rigid, forwardly inclined storage unit having upper and lower ends and comprising:

a floor member and first and second panels, said panels being forwardly inclined, said floor member being flat and downwardly inclined from said second panel to said first panel, said panels having upper and lower ends and forward and rearward sides, the lower ends of said panels being fixed to said floor member spaced apart on same a given distance; the space effectively enclosed between said panels and floor member defining a storage compartment; said panels standing in freely spaced apart relationship whereby said storage compartment is open at the top and at laterally opposed sides;

said first panel:

rising sharply and substantially squarely from said floor member;

having a length as measured from its extreme upper end to said floor member at least equal to the length of said paper; and, having a width at least a portion of which is less than the width of said paper;

said second panel:

having its lower end spaced apart from the lower end of said first panel just for enough to provide storage capacity for said given number of pages plus clearance between the last of said number of pages and the forward side of said second panel sufficient for freely dropping said last page into said storage compartment;

having a length as measured from its extreme upper end to said floor member at least equal to the length of said first panel;

having its upper end spaced at least as far apart from the upper end of said first panel as the lower end of said second panel is spaced apart from the lower end of said first panel and thereby forming a nonacute angle with said floor member; and, being rigid enough to maintain the above-recited spaced apart relationship between the upper ends of said panels;

said storage unit being located behind and having its first panel secured to said copyboard such that said first panel and said copyboard converge at their upper ends like opposed sides of a pyramid and said storage unit as a whole is thereby forwardly inclined.

9. A copyholder/organizer providing its copyboard elevated and the area under same clear for placement of rider pages and providing lateral adjustability of the copyboard for positioning same close to the display screen of a desktop personal computer by rotation of the copyholder/organizer as a whole on the desktop; comprising, in combination with the subject matter of claim 8:

a nonweighted base adapted to rest on a desktop, said base including an elongated planar portion sufficiently planar in form for resting a rider page on same;

said planar portion having a rearward end that is wide enough to provide lateral support for both said storage unit and said copyboard, a forward end having a width no greater than one-half the width of its rearward end, and opposed sides extending symmetrically between said forward and rearward ends;

means securing the rearward end only of said planar portion to the lower end of said storage unit such that said planar portion is free and said storage unit is maintained at its forward inclination solely by said base;

said storage unit providing the sole support for said copyboard and supporting said copyboard at its rearward inclination and such that its shelf is spaced at least three inches above said desktop;

said planar portion extending forwardly from the lower end of said storage unit so as to underlie but being free of said copyboard and providing full support of the storage unit/copyboard subcombination by extending under the center of gravity of same, said planar portion having its forward end terminating rearwardly of said shelf; whereby:

an unobstructed space is provided under said copyboard overlying said planar portion, said space extending from a point under said shelf rearwardly therefrom fully to the lower end of said storage unit for placement of rider pages resting on the planar portion of said base; and, when said copyholder/organizer as a whole is rotated so that one side of said planar portion of said base is positioned in abutment against one end of the structure of said computer, a portion of said copyboard's shelf overlies that end of the computer's keyboard and said copyboard as a whole is thereby positioned laterally closer to the computer's display screen than would be possible if the forward end of said planar portion were not provided having said width.

10. A portable copyholder/organizer; comprising, in combination with the subject matter of claim 9:

means pivotally securing the rearward end of the planar portion of said base to the lower end of said storage unit for rotation of said planar portion about a base pivot axis, providing an unfolded position of said base wherein said storage unit is positioned at its forward inclination and an alternate folded position of said base wherein the forward end of its planar portion is located near the forward side of said first panel;

base lock means adapted to lock said base in said unfolded position, and alternatively, to release said base for folding;

means pivotally securing the upper end of said copyboard to the upper end of said first panel for rotation of said copyboard about a coptboard pivot axis, providing an unfolded position of said copyboard wherein it is positioned at its rearward inclination and an alternate folded position of said copyboard wherein its shelf is located near the forward side of said first panel;

copyboard lock means adapted to lock said copyboard in said unfolded position, and alternatively, to release said copyboard for folding;

the pivotal axes of said copyboard and base being located such that said copyboard and said planar portion fold one overlapping the other.

11. A portable copyholder/organizer; comprising, in combination with the subject matter of claim 9:

the lower end of said storage unit being provided with a pair of lugs depending from said floor member and laterally spaced apart under same; said lugs extending fore and aft of said floor member so as to encompass said panels for stiffening said floor member and reinforcing a pair of tapered panelribs provided extending forwardly from laterally opposed edges of said first panel and continuing downwardly into said lugs whereby said first panel is in turn stiffened, said panelribs having their greatest width at the upper end of said first panel;

said base being provided having a rearward portion distinct from said planar portion and providing a pair of upright members which are laterally spaced apart to stand adjacent said lugs;

means pivotally securing said upright members to said lugs for rotation of the planar portion of said base about a base pivot axis that extends through said lugs and upright members, providing an unfolded position of said base wherein said storage unit it is positioned at its forward inclination and an alternate folded position of said base wherein the forward end of its planar portion is located near the forward side of said first panel;

base lock means arranged between said lugs and upright members, adapted to lock said base in said unfolded position, and alternatively, to release said base for folding;

said copyboard being provided including a pair of tapered boardribs that extend rearwardly from laterally opposed edges of said copyboard whereby said copyboard is stiffened, said boardribs having their greatest width at the upper end of said copyboard and being located outboard of said panelribs;

means pivotally securing said boardribs to said panelribs for rotation of said copyboard about a copyboard pivot axis, providing an unfolded position of said copyboard wherein it is positioned at its rearward inclination and an alternate folded position of said copyboard wherein its shelf is located near the forward side of said first panel;

copyboard lock means arranged between said boardribs and said panelribs adapted to lock said copyboard in said unfolded position, and alternatively, to release said copyboard for folding.

12. A portable copyholder/organizer as in claim 11 wherein:

said upright members stand between said lugs;

said base lock means comprises said lugs being provided with a pair of storage unit lock openings aligned on a base lock axis located parallel to and spaced apart from said base pivot axis, said upright members being provided with a pair of open-ended sleeves aligned on said base lock axis, and a pushbutton lock/release device being provided comprising two telescoping tubes and an expansion spring extending longitudinally inside the tubes, said tubes having free ends which are closed and reduced in diameter to form pushbuttons having shoulders, the pushbuttons being normally impelled apart along the longitudinal axis of said tubes under the bias of said spring, said device being installed between said upright members by means of end portions of said tubes between the shoulders thereof being journaled in said sleeves, the inside diameter of said sleeves being large enough to accommodate said end portions but said storage unit lock openings having a relatively smaller diameter large enough to accommodate only said pushbuttons.

13. A portable copyholder/organizer as in claim 11 wherein:

the means pivotally securing said boardribs to said panelribs comprises a pair of copyboard pivot teats that are provided on one pair of ribs aligned on said copyboard pivot axis and that register in copyboard pivot openings provided in the other pair of ribs;

said copyboard lock means comprises a pair of copybaord lock teats provided on one pair of ribs spaced apart from the copyboard pivot teats, and which copyboard lock teats register, alternatively, in first and second pairs of copyboard lock openings provided in the other pair of ribs, the copyboard lock openings on each given rib being located at a common radius from their cooperating lock teat and arcuately spaced apart to effect said folded and unfolded positions of said copyboard at each of which positions said copyboard is locked when the copyboard lock teats enter into the copyboard lock openings, and, said boardribs being manually flexible outboardly away from said panelribs, such that, by manually pulling the boardribs apart the copyboard lock teats are caused to become disengaged from the currently engaged copyboard lock openings, thereby permitting rotation of the copyboard around said copyboard pivot teats for engagement of said copyboard lock teats in the other pair of copyboard lock openings;

the combination being so constructed and arranged that said copyboard is foldable overlying the planar forward portion of said base, as a result of which, when said copyboard is locked in its folded position the base is likewise secured.

14. A portable copyholder/organizer as in claim 12 wherein:

the means pivotally securing said upright members to said lugs comprises said lugs being formed to provide a first pair of shaft bearings, said upright members being formed to provide a second pair of shaft bearings, and a shaft being provided that extends through said first and second pairs of shaft bearings;

said storage unit comprises distinct forward and a rearward sections divided on a parting plane that splits said floor member and said lugs into forward and rearward halves, the forward half of said floor member and lugs being molded integrally with said first panel, the rearward half of said floor member and lugs being molded integrally with said second panel;

means for rigidly fastening said forward and rearward sections together to form a unitary storage unit;

said parting plane dividing said floor member irregularly to prevent pages from becoming stuck between the forward and rearward halves of said floor member;

said parting plane dividing said lugs such that said first pair of shaft bearings and said storage unit lock openings are divided into equal halves.

* * * * *